US008225705B2

(12) United States Patent
Dubois et al.

(10) Patent No.: US 8,225,705 B2
(45) Date of Patent: Jul. 24, 2012

(54) FIREARM

(75) Inventors: Michael Dubois, Etterbeek (BE); Xavier Robert Paul Gavage, Chaudfontaine (BE); Pascal Marcel Henri Denis Franssen, Saint-Remy (BE)

(73) Assignee: FN Herstal, S.A., Herstal (BE)

( * ) Notice: Subject to any disclaimer, the term of this patent is extended or adjusted under 35 U.S.C. 154(b) by 264 days.

(21) Appl. No.: 12/580,508

(22) Filed: Oct. 16, 2009

(65) Prior Publication Data

US 2010/0095833 A1 Apr. 22, 2010

(30) Foreign Application Priority Data

Oct. 17, 2008 (BE) ..... 2008/0574

(51) Int. Cl.
*F41A 5/00* (2006.01)

(52) U.S. Cl. ..... 89/140; 89/132; 89/138

(58) Field of Classification Search ..... 89/132, 89/138–140

See application file for complete search history.

(56) References Cited

U.S. PATENT DOCUMENTS

| | | | | |
|---|---|---|---|---|
| 2,858,741 | A | 11/1958 | Simpson | |
| 3,618,455 | A * | 11/1971 | Plumer | 89/132 |
| 7,806,039 | B1 * | 10/2010 | Gomez | 89/132 |
| 2007/0051236 | A1 * | 3/2007 | Groves et al. | 89/142 |
| 2010/0236394 | A1 * | 9/2010 | Gomez | 89/138 |

OTHER PUBLICATIONS

Written Opinion and International Search Report of the EPO regarding Belgium patent application No. BE2008/00574, Jul. 3, 2009.

* cited by examiner

*Primary Examiner* — Michael Carone
*Assistant Examiner* — Samir Abdosh
(74) *Attorney, Agent, or Firm* — Bacon & Thomas, PLLC

(57) ABSTRACT

Automatic firearm with firing mode selector (6) to change the firing mode from automatic firing mode to semi-automatic firing mode, where the firearm (1) is equipped with a firing mechanism (11) with selection control (37) which enables the firearm (1) to function in closed bolt firing mode or open bolt firing mode, and in automatic firing mode as well as semi-automatic firing mode in both closed and open bolt firing mode.

17 Claims, 24 Drawing Sheets

FIREARM

BACKGROUND

A. Field

The invention concerns an automatic firearm.

B. Related Art

For small calibre automatic firearms, there are two types of mechanisms according to the designated use, in particular:

Firing mechanisms from the closed bolt characterized by the presence of a cartridge in the ammunition chamber before firing (set off by applying pressure on the trigger), the operating group being in a ready to fire position and only pressure applied to the trigger releases the firing mechanism and strikes the ammunition; and, Open bolt mechanism, characterized by the absence of a cartridge in the chamber before the start of firing (also set off by applying pressure on the trigger), the operating group being held in a back position and released when pressure is applied to the trigger, the mechanism must then insert a cartridge into the chamber and lock it before releasing the firing mechanism and striking the ammunition.

The design for firing with closed bolt is used mainly for rifles because it makes the firearm more accurate, with a high hit probability with the first shot, and less susceptible to contamination from the environment (sand and dust, mud).

This design has the major drawback of allowing firing a limited number of cartridges over a given period (firing conditions), because after the number of cartridges have been shot, the chamber and barrel heat up considerably, and if the firing stops with a cartridge loaded in the chamber, it can heat up to the point of spontaneous combustion.

This self-ignition of the propellant in the cartridge is commonly called cook-off.

To counter this major drawback, an open bolt firing design is currently used. It is characterized by the fact that before firing, all the operating group is held in retracted position and that there is no ammunition in the chamber.

When pressure is applied to the trigger, the operating group is released: a cartridge is fed into the chamber, which is then struck at the end of the forward run of the mechanism.

This open bolt functioning principle is regularly used in machine-guns, providing them with a capability of firing high volumes of ammunition without the risk of self-ignition of the ammunition.

The inconvenience of this design is in the limited accuracy, which is not as good as it is with a firearm firing from the closed bolt position, and a lower resistance to fouling since when the firing stops, the mechanism is in the back position and the chamber is open and exposed to contamination from detritus, dust or other environmental pollution.

Some firearms have been designed to make up for these flaws. It is mainly the case of the FG-42 automatic rifle and the Johnson Machine Gun which were firing semi-automatic from the closed bolt position, and automatic firing from the open bolt position. These firearms only provide incomplete solutions to the problem, since the self-ignition risk still exists in semi-automatic firing mode and these firearms are still less precise and exposed to environmental pollution when they are used in automatic firing mode.

BRIEF SUMMARY OF THE DISCLOSURE

The objective of this invention is to avoid the above-mentioned inconveniences and applies to an automatic firearm with firing mode selector to be able to use both automatic firing mode and semi-automatic firing mode, and which is characterized by the fact that the firearm is equipped with a firing mechanism with a selection control, which enables to operate the firearm in closed bolt firing mode or open bolt firing mode, this in both automatic firing mode as well as semi-automatic firing mode.

The selection of the semi-automatic or automatic firing mode is made using a selector easily manipulated by the user.

The selection of closed or open bolt firing mode is preferably made using a thermal actuator connected to the barrel.

This actuator is activated by the heat coming from the barrel, which makes the mechanism switch from closed bolt mode to open bolt mode before the barrel reaches the critical temperature level as of which there is a risk of self-ignition of the cartridge if it stays long enough in the chamber.

In this way, the firearm can be accurate and more reliable when the temperature of the barrel is low and also allows firing of high volumes of ammunitions without risking the self-ignition problem (cook-off) of the cartridge.

The invention concerns an automatic firearm, which includes:

A thermal actuator connected to the barrel;

A mechanism that transfers the movement of the thermal actuator to a control rod;

A control rod;

A firing mechanism that includes a hammer, a catch, called slide catch, and elements to synchronize these two parts.

The invention also concerns a firing mechanism applicable to a firearm, based on the invention.

DESCRIPTION OF THE DRAWINGS

For clarity's sake, an example of the embodiment of an automatic firearm according to the invention is described below on an illustrative basis and without being limitative in any way, with reference to the accompanying drawings, in which.

DETAILED DESCRIPTION OF PREFERRED EMBODIMENTS OF THE INVENTION

Figure 1:
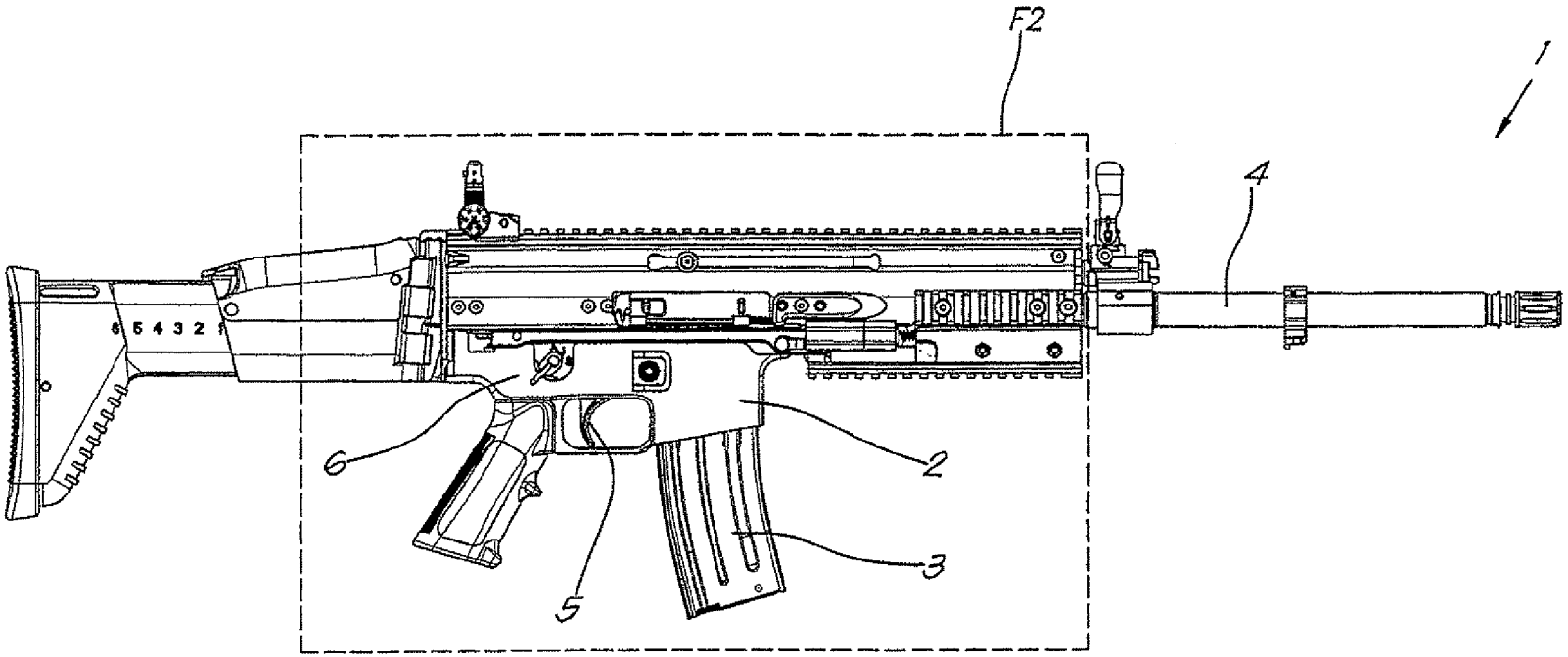
FIG. 1 is the lateral view of an automatic firearm according to the invention.
Figure 2:
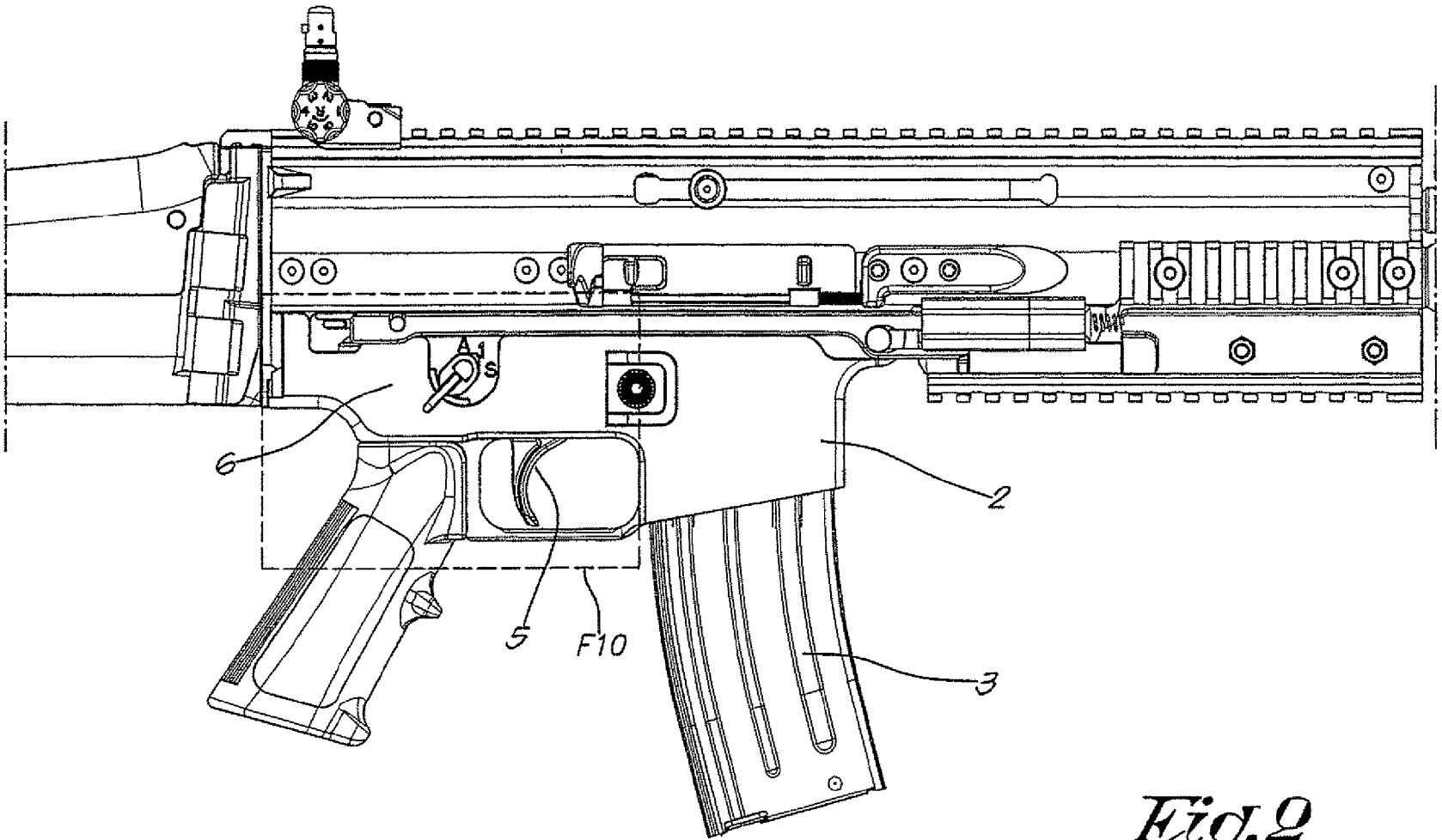
FIG. 2 is a view on a larger scale of the part according to F2 in FIG. 1.
Figure 3:
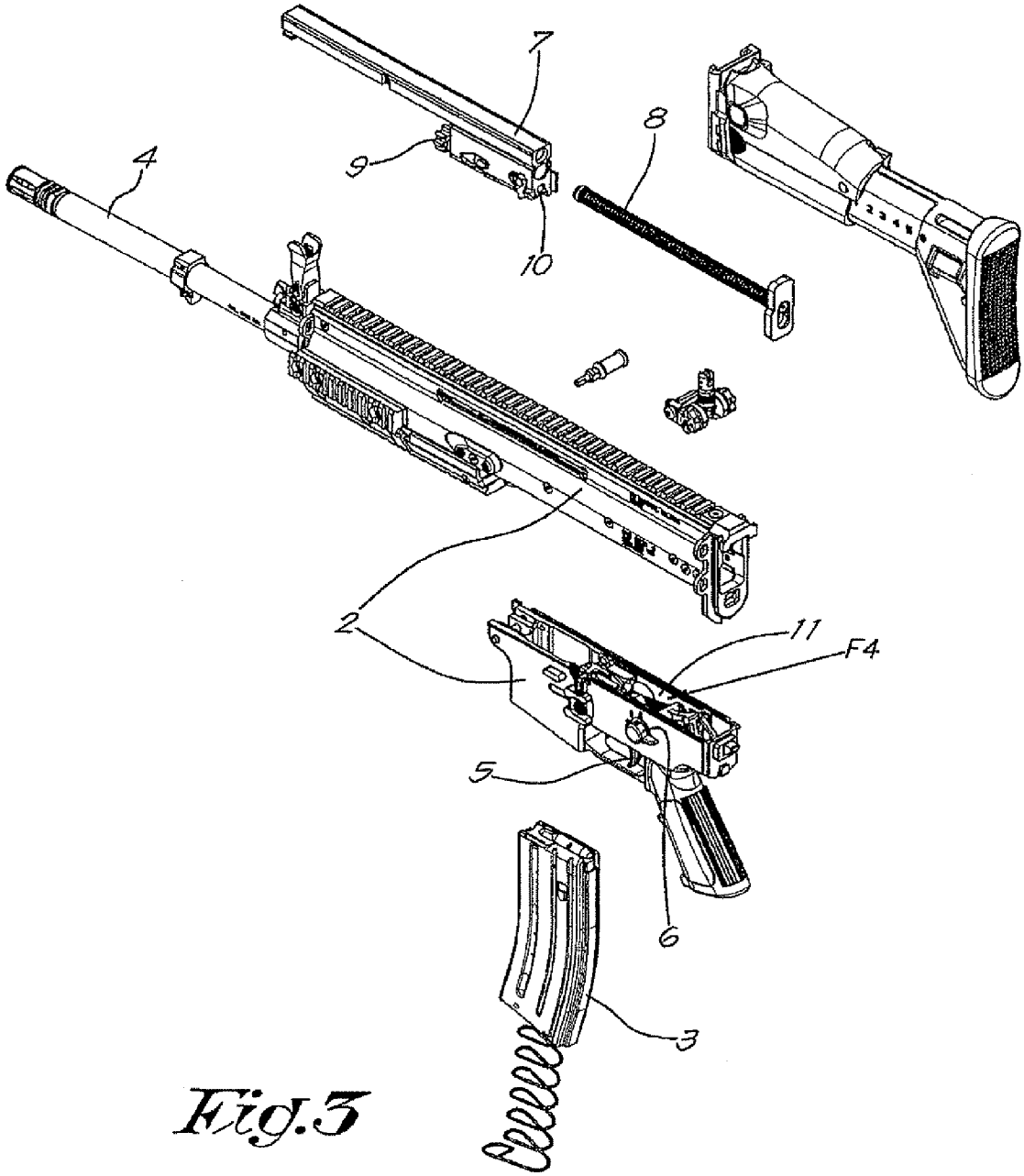
FIG. 3 is an exploded view in perspective of the firearm in FIG. 1.

Firearm 1 according to the invention comprises a receiver 2; an ammunition loader 3; a barrel 4; a trigger 5 and a firing selector 6 with three positions, easily manipulated by the user in between an automatic firing mode(indicated by A) or a semi-automatic firing mode, meaning single shot (indicated by 1), or in security mode (indicated by 8).

Firearm 1 also comprises a slide 7 which is mounted in the receiver in a sliding manner in the axial direction of the barrel 4, between a retracted position and a forward position in order to be able to load one of the cartridges of the loader 3 in the ammunition chamber located in barrel extension 4' of the barrel 4.

The slide 7 is equipped with a recoil spring 8, which pushes the slide 7 in the direction of the barrel 4.

The slide 7 is equipped with a bolt 9 in order to be able to lock a cartridge in the chamber in the forward position of the slide 7, and a pin 10 that crosses through the slide while sticking out at the back of the slide 7 and a percussion mechanism to set off the pin 10.

Figure 4:
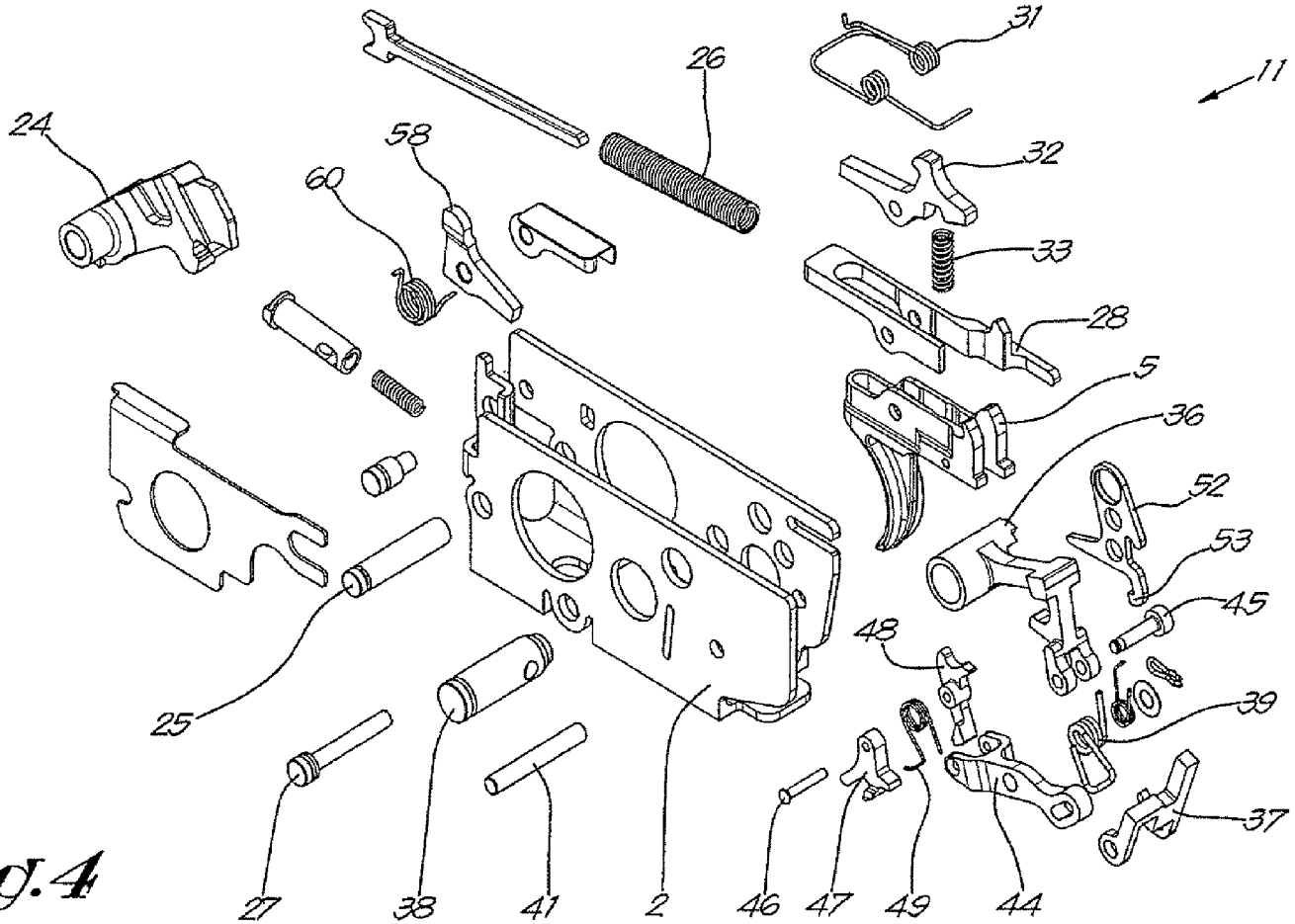
FIG. 4 is an exploded view of the firing mechanism according to F4 in FIG. 1.
Figure 5:
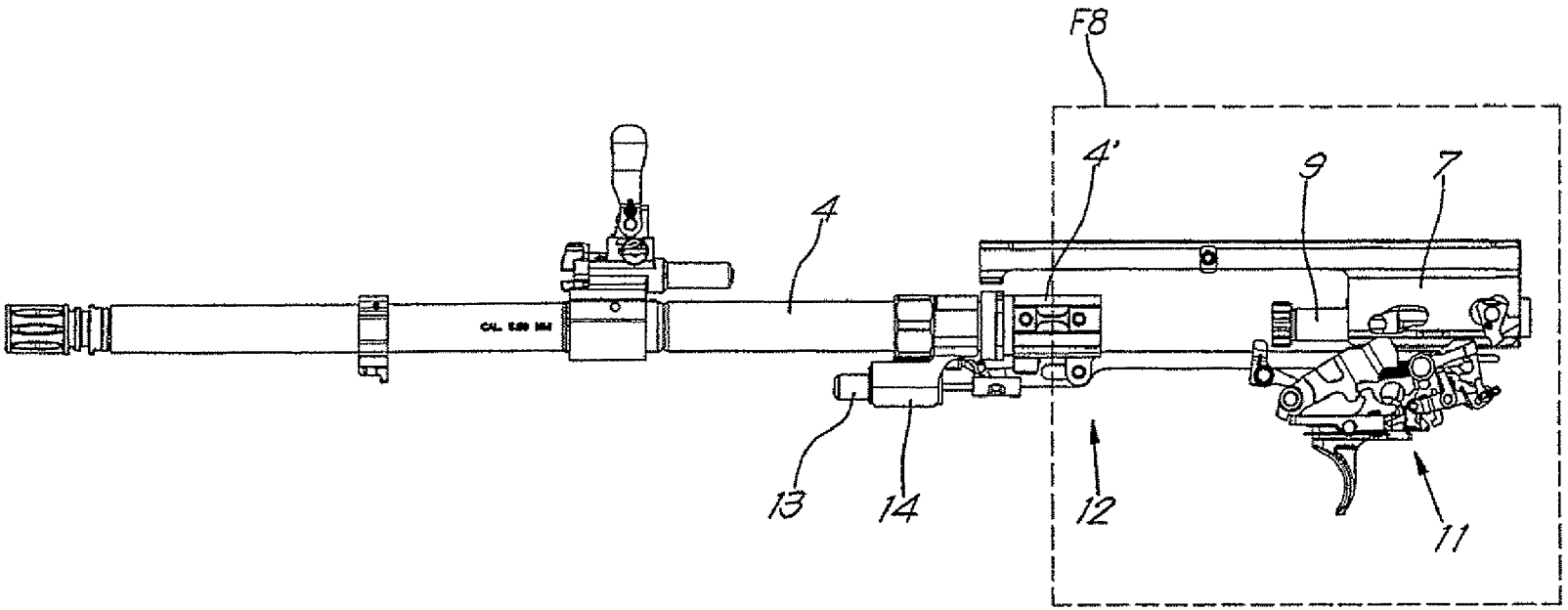
FIG. 5 is a left lateral view of the mechanical assembly of the firearm in FIG. 1, but without the metal plates and frame.
Figure 6:
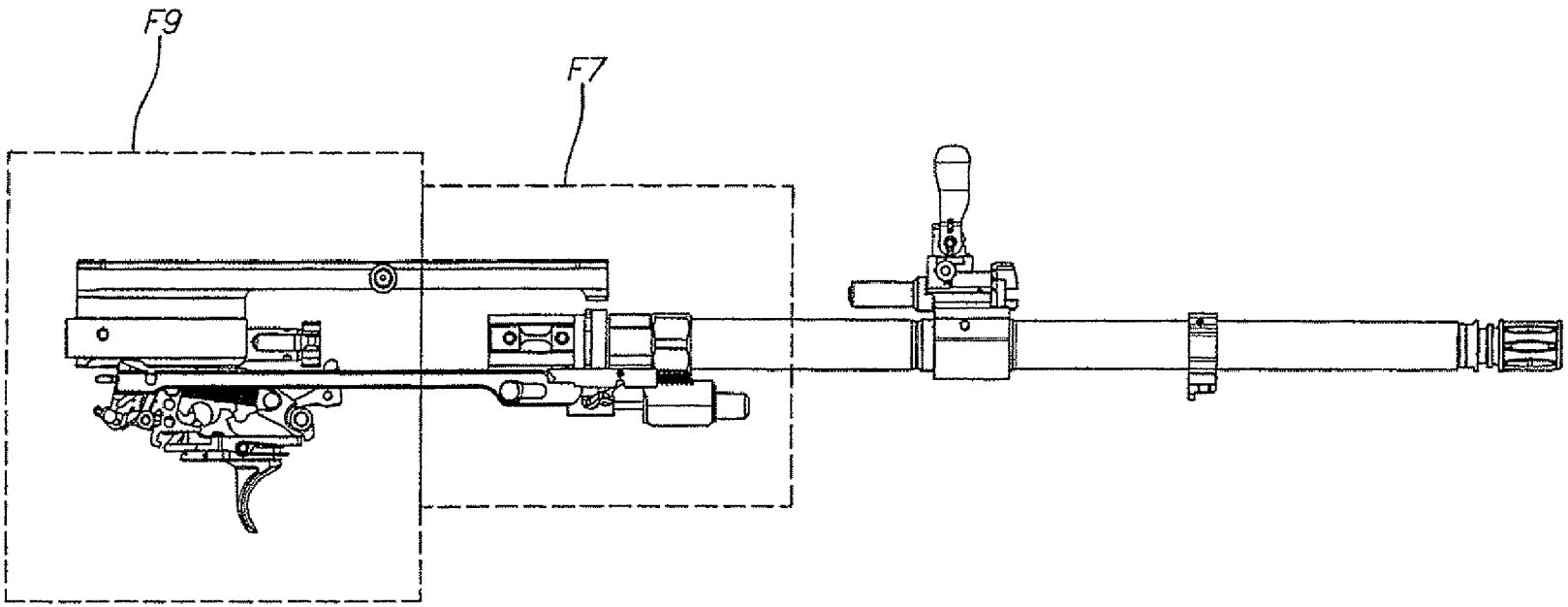
FIG. 6 is a view similar to FIG. 5 but of the right side.

The firing selector 6 and the trigger 5 are part of a firing mechanism 11 that is presented in an exploded view in FIG. 4 and that is linked by a transmission system 12 to a thermal actuator 13, which, as in FIGS. 5 and 6, is mechanically connected by a connection ring 14 to the barrel 4 and allows the transfer of the functioning from <<closed bolt>> mode to <<open bolt>> mode when the temperature of the barrel 4 reaches or exceeds a pre-determined temperature and inversely controls the transition from open bolt to closed bolt when the temperature of the barrel becomes lower than a pre-determined temperature.

Figure 7:
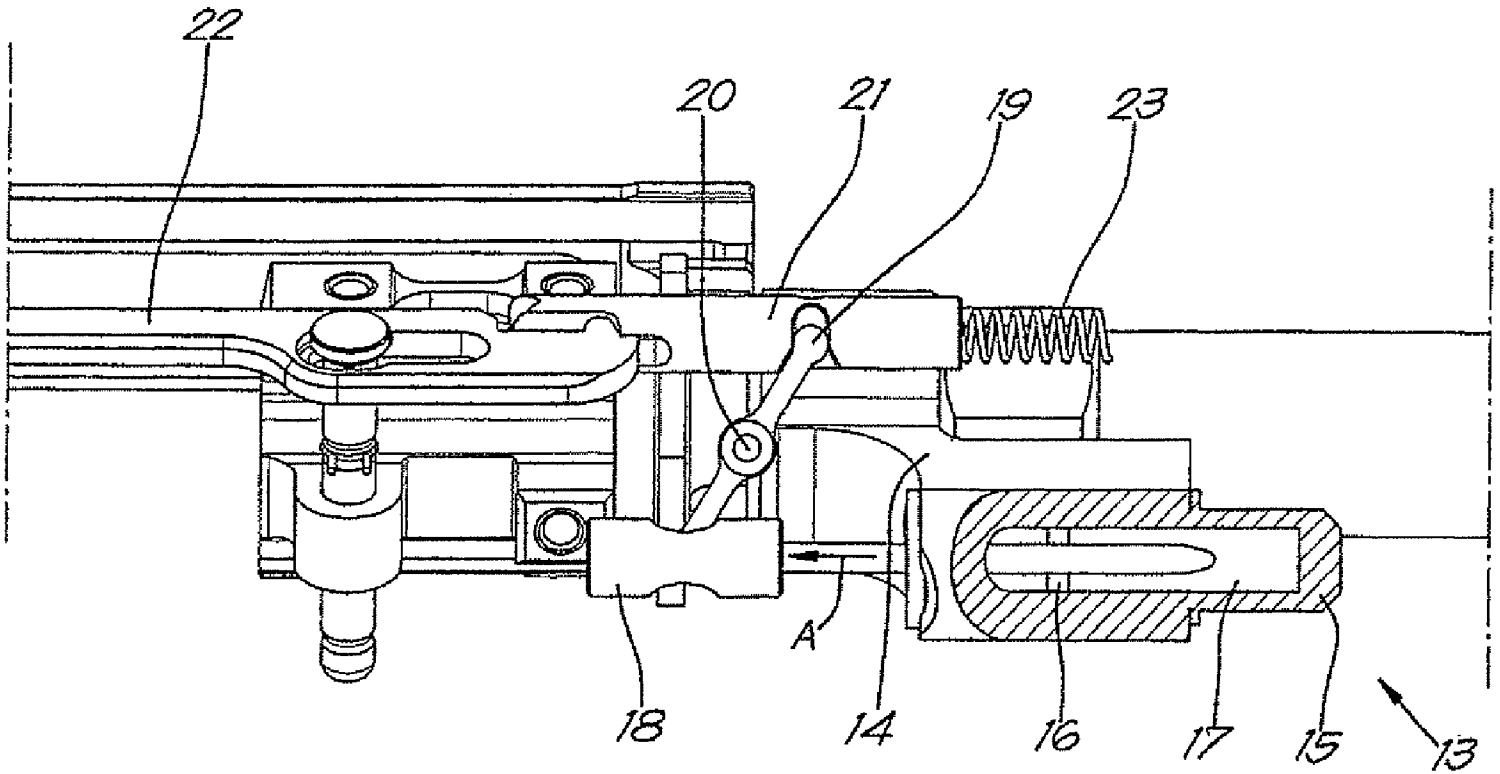
FIGS. 7, 8 and 9 represent, on a larger scale, the parts according to F7, F8 and F9 respectively in FIGS. 5 and 6 and in a rest situation with open bolt semi-automatic firing mode.

The thermal actuator 13 is an actuator with phase change material that includes, as represented by FIG. 7, a cylinder 15 and a piston 16 that delimits a chamber 17 inside the cylinder 15, the chamber 17 being filled with a material that changes phase when reaching the above-mentioned pre-determined temperature, this phase change is accompanied by a significant volume change of 10% to 20% and which, for example, goes from the solid state to the liquid state and through the expansion due to the phase change, generates a movement of the piston 16 in the direction of the arrow A in FIG. 7.

This position of the piston 16 is transferred to the firing mechanism 11 via the transmission system 12, which includes a push rod 18, a rocker 19 that can pivot over an axis 20 and a push rod 21 connected to the firing mechanism 11 by a control rod 22.

A release spring 23 forces the piston 16 to enter the cylinder 15 of the thermal actuator 13 when the material contained in the chamber 17 of the thermal actuator goes from the liquid state to the solid state, this transfer from the liquid state to the solid state being accompanied by a considerable volume contraction.

The firing mechanism 11 includes a hammer 24, which is part of the firing device and which can pivot around an axis 25 of the receiver 2 to strike the pin 10 under the effect of a spring 26 which is armed by the backward movement of the slide 7 and which is released when the trigger 5 is pressed, pivots around a pivot 27 and drives the hammer catch 28.

Figure 8:
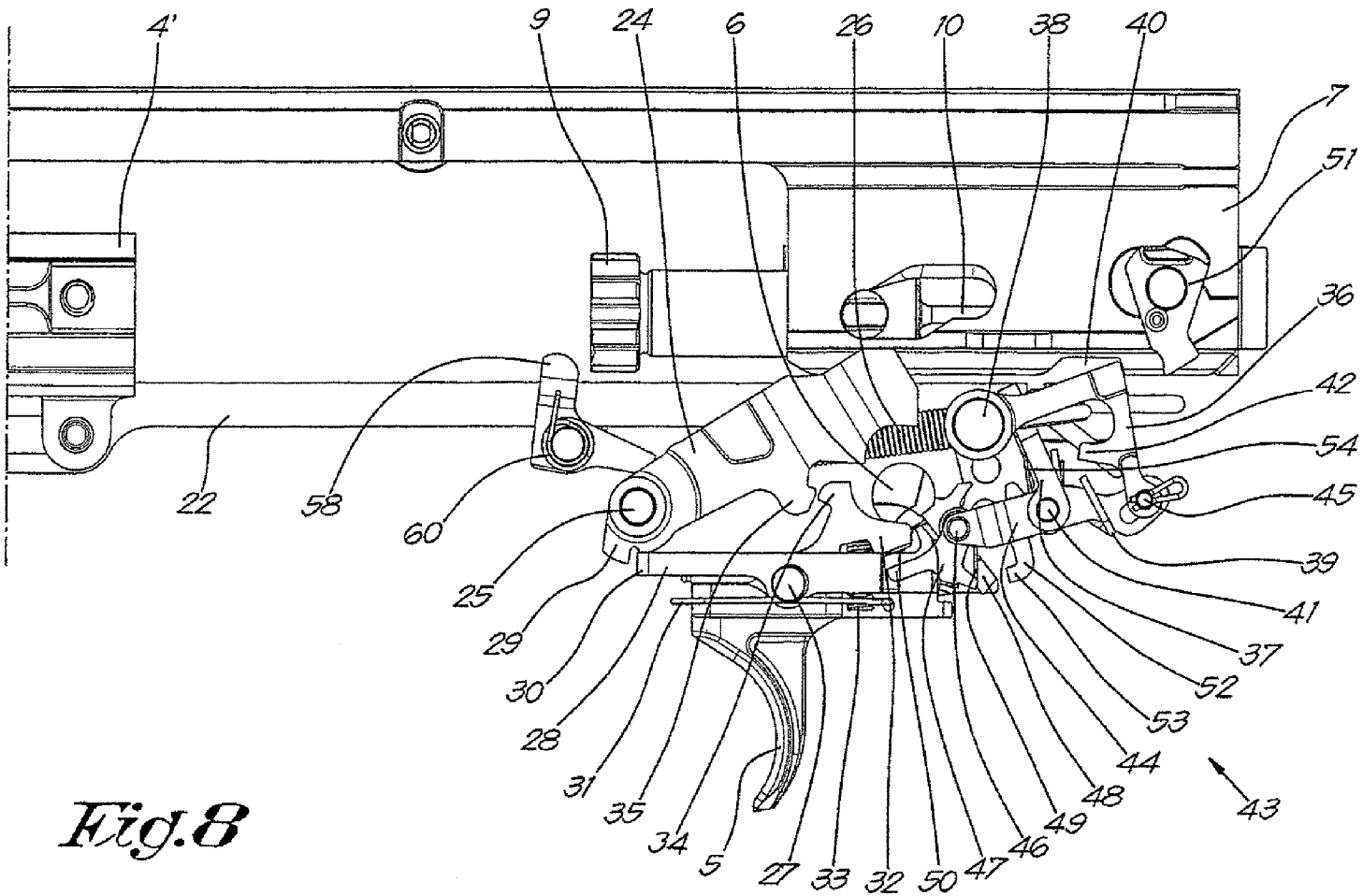
Figure 9:
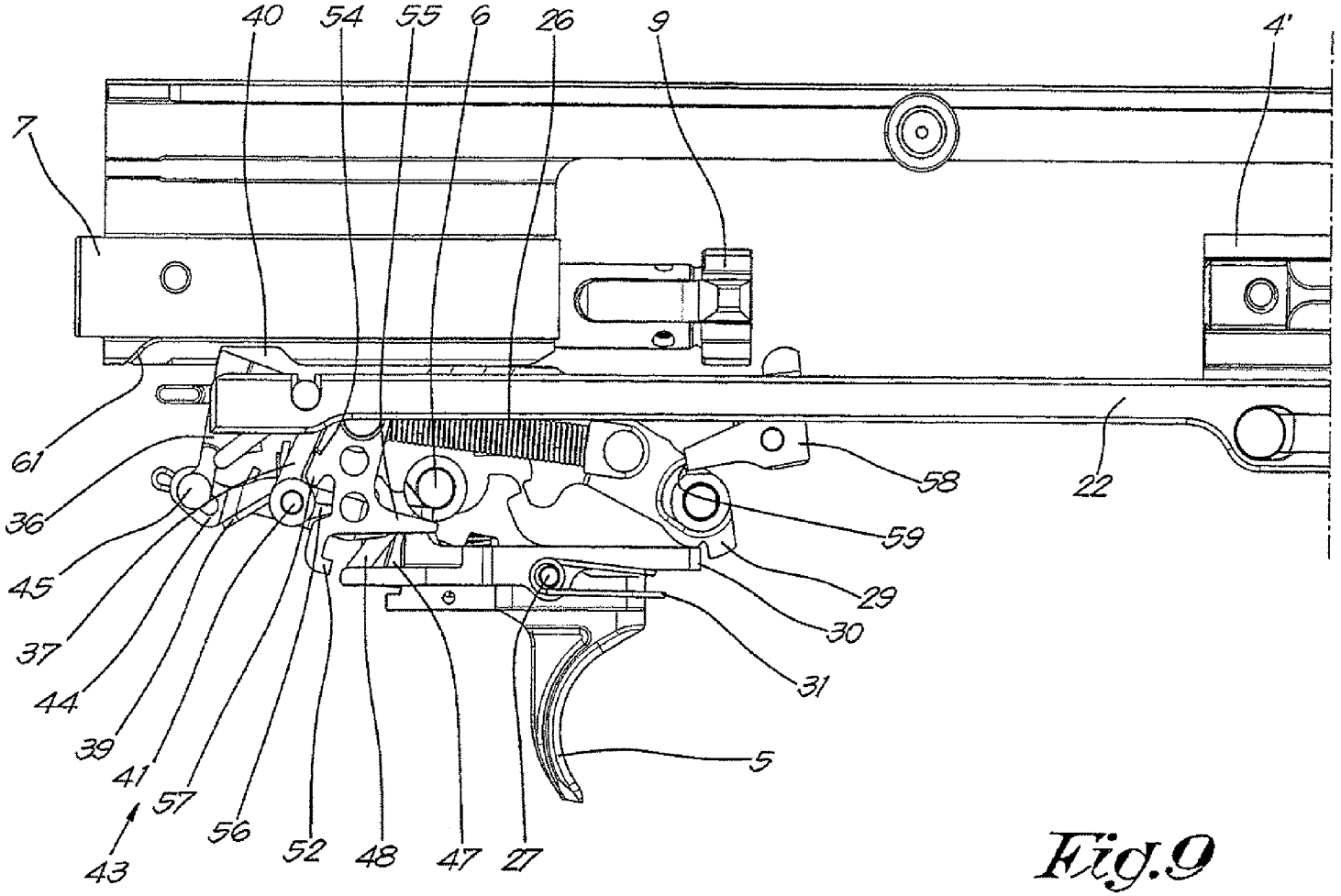

The firing mechanism 11 is presented in more detail in FIGS. 8 and 9 which show the fire arm in rest position with the firing selector 6 in semi-automatic firing mode.

These figures show that the trigger 5 comprises a hammer catch 28 supported by the pivot 27 to hold the hammer 24 in an armed position as long as the trigger 5 is not pressed and to release the hammer 24 when the trigger is pressed.

To this effect, the hammer 24 is equipped with a shoulder 29, which fits with the front side 30 of the hammer catch 28 that is fitted with a release spring 31 that holds this front side 30 in front of the shoulder 29.

The trigger 5 is also equipped with a single shot catch 32 blocking the hammer 31 in an armed position as long as the trigger 5 is not released after a shot is fired.

This single shot catch 32 is supported by the pivot 27 of the trigger and is held in a raised position by a release spring 33. The catch 32 is equipped with a hook 34 which can cooperate with another hook 35 corresponding to the hammer 24.

The firing mode selector 6 enables the selection between automatic or semi-automatic mode and is designed to activate the single shot catch 32 in semi-automatic mode and to deactivate this catch 32 in automatic firing mode. In order to do this, the axis of the selector 6 is profiled in such a way that in automatic mode, the rotation movement of the catch 32 is blocked by the firing selector 6, which prevents the hook 35 of the hammer 32, from locking into the hook 34 of the catch 32, whereas in semi-automatic mode, the single shot catch 32 is not blocked in its rotation and can pivot when the trigger is pressed to allow the hammer 24 to lock in an armed position through the hook 35 of the hammer 34 and the hook 34 of the catch 32.

The firing mechanism 11 also includes a slide catch 36 and a selection control 37 which is controlled by the thermal actuator 13 via the control rod 22, and according to the position of this control 37, can block the slide catch 36 in a position clearing it from the slide 7 to fire a shot from the closed bolt position, or to release the slide catch 36 to fire a shot from the open bolt position so that this slide catch 36 is locked and blocks the movement of the catch 7 in a retracted position as shown in FIG. 8.

The slide catch 36 is an L-shaped part with a release end that pivots around an axis 38 which is secured to the receiver 2.

A release spring 39 connecting to the control lever 44 holds the slide catch 36 in a raised position so that the slide catch can enter through its upper section into a recess 40 placed in the back part of the slide 7.

The selection control 37 is designed as a rocker that pivots around an axis 41 secured to the receiver 2.

Figure 18:
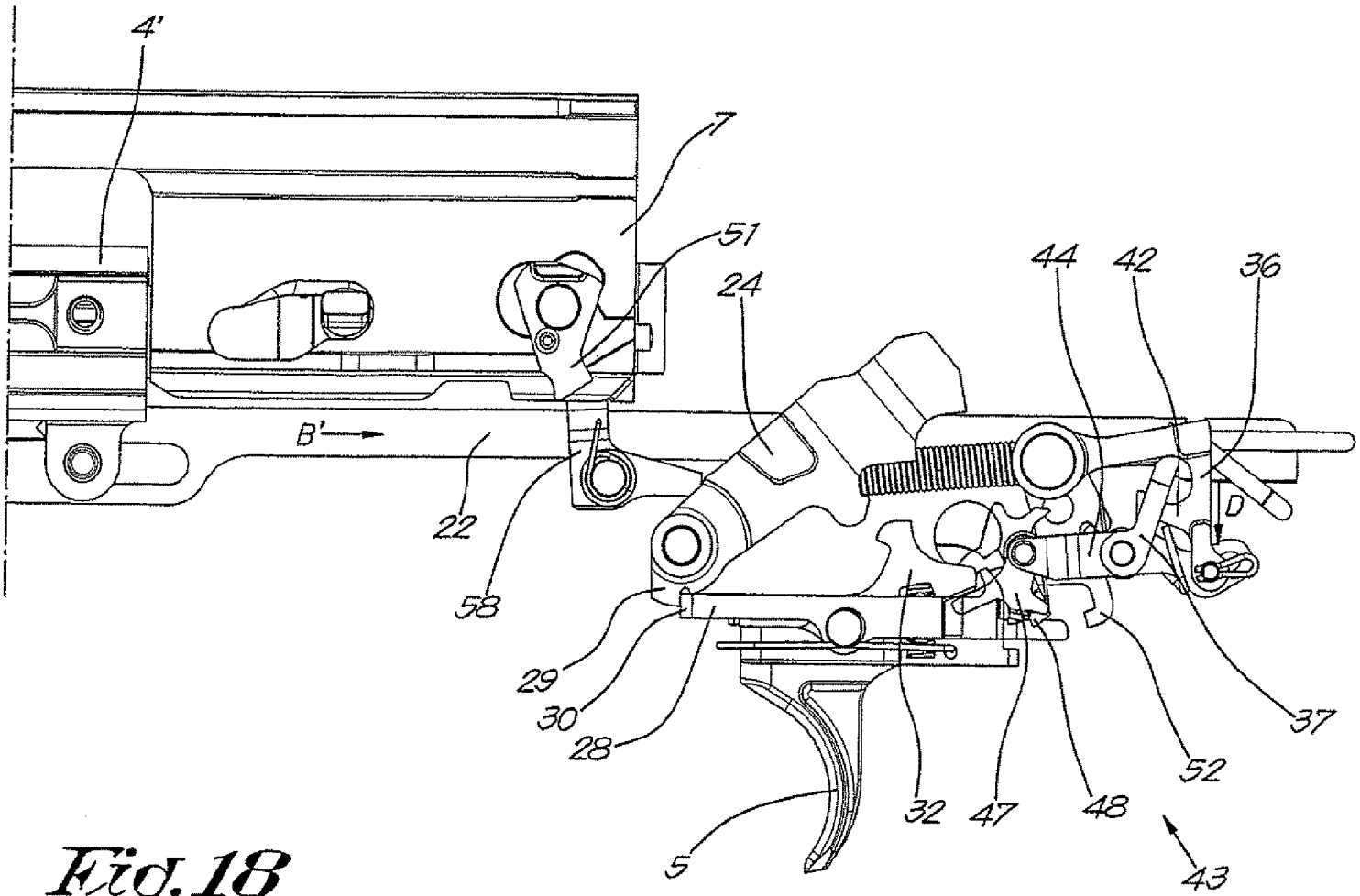
FIGS. 18 and 19 are lateral views similar to FIGS. 8 and 9 respectively, but in rest situation with closed bolt semi-automatic firing mode.

In the closed bolt firing mode, this rocker 37 can block the slide catch 36 in a position clearing it from the slide 7 by applying pressure to a protrusion 42 of the catch 36 as indicated in FIG. 18, whereas in the open bolt firing position as indicated in FIG. 8, the rocker 37 can not block the movement of the slide catch 36.

A synchronization mechanism 43 is planned between the hammer 24 and the slide catch 36 and in the example shown, between the single shot catch 32 and the slide catch 36.

This synchronization mechanism includes a control lever 44 which can pivot around the axis 41 and is equipped with the catch spring 39.

One end of the control lever 44 is linked to one end of the slide catch 36 by a hinge 45.

The other end of the control lever 44 is equipped with a rotation axis 46 which supports two ratchets, one ratchet for the semi-automatic mode 47 and one ratchet for the automatic mode 48.

Figure 10:
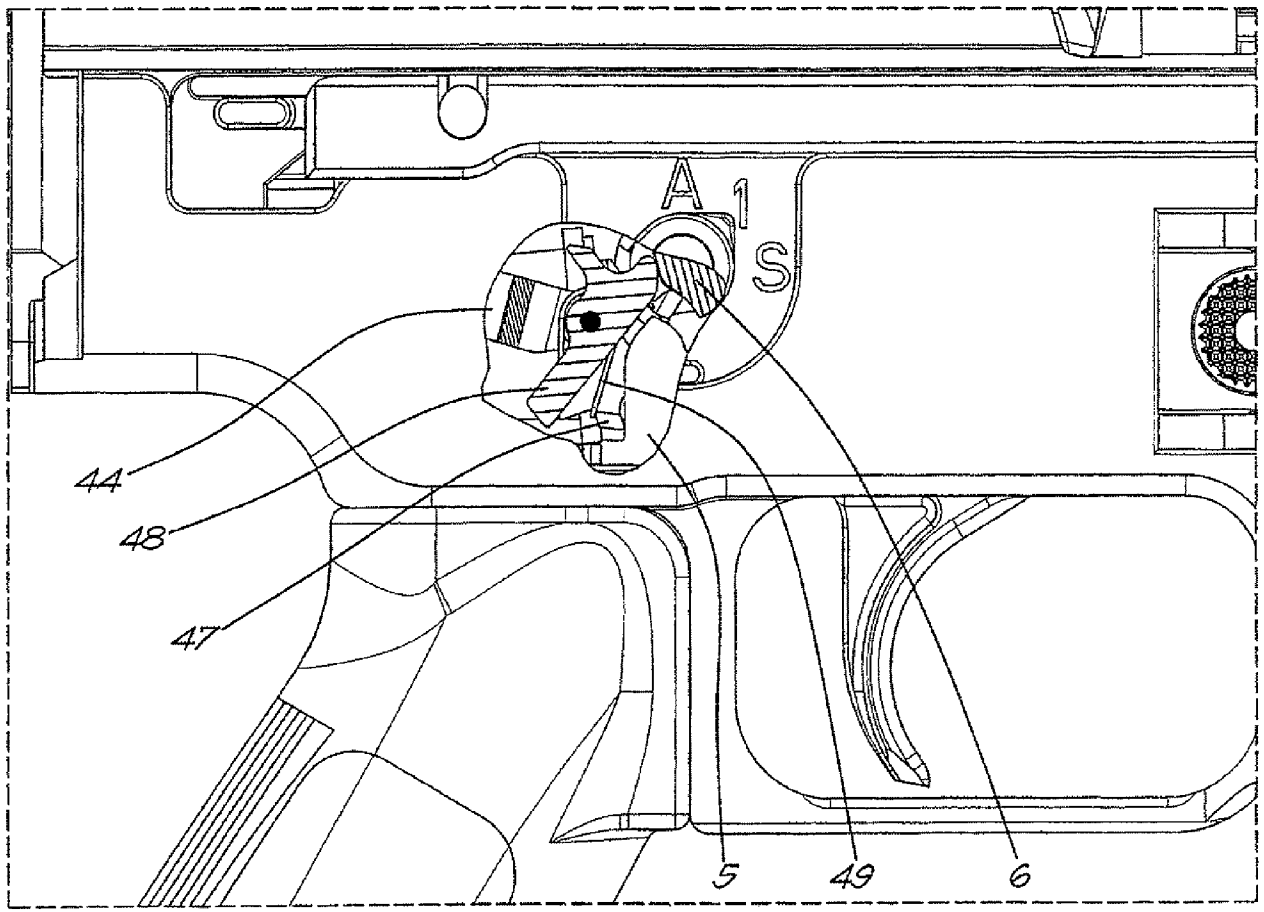
FIG. 10 represents, on a larger scale, the part according to F10 in FIG. 2 with certain parts taken out.
Figure 11:
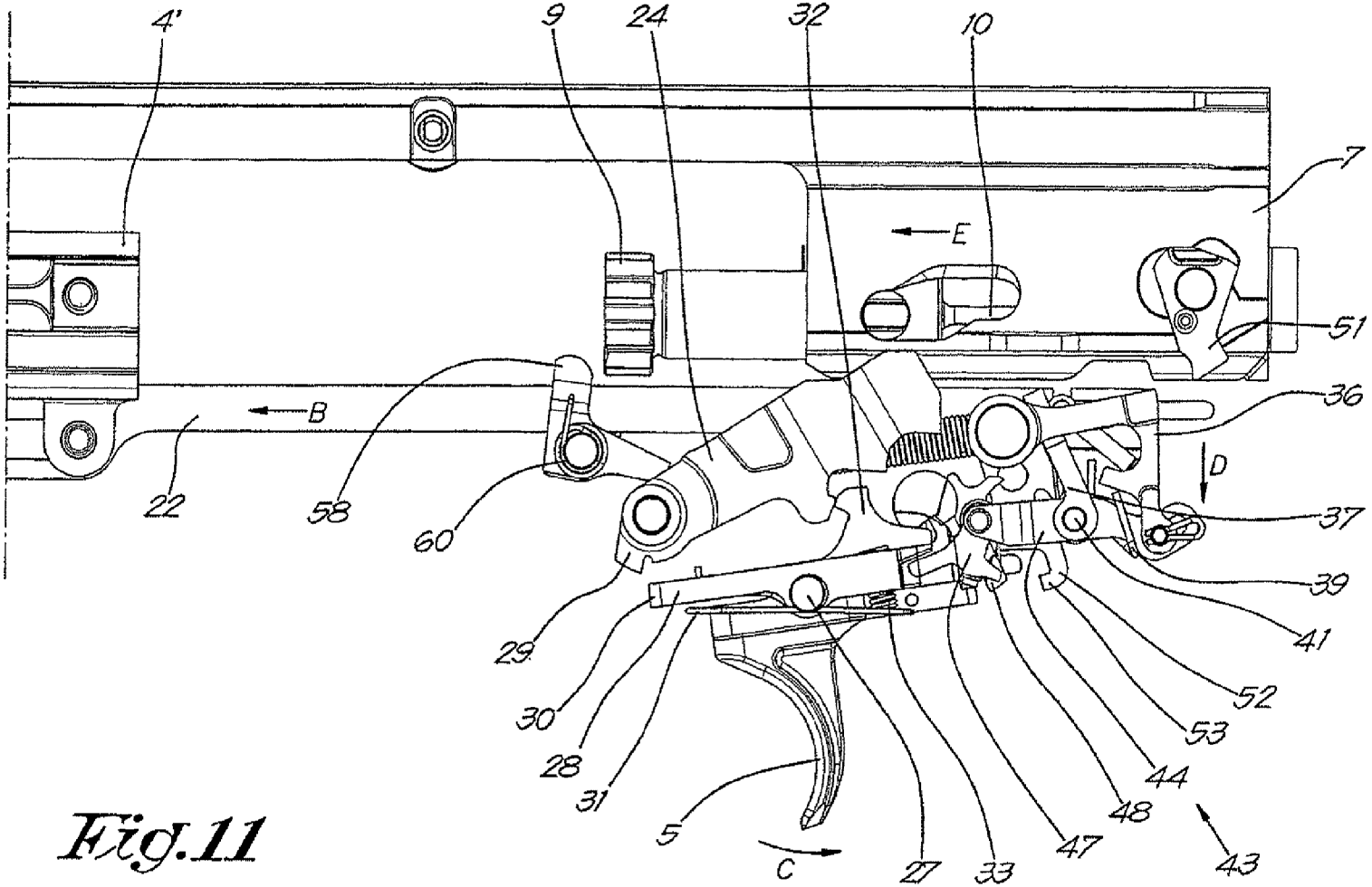
FIGS. 11 to 14 are views similar to FIG. 8, but at different moments in succession during firing.
Figure 16:
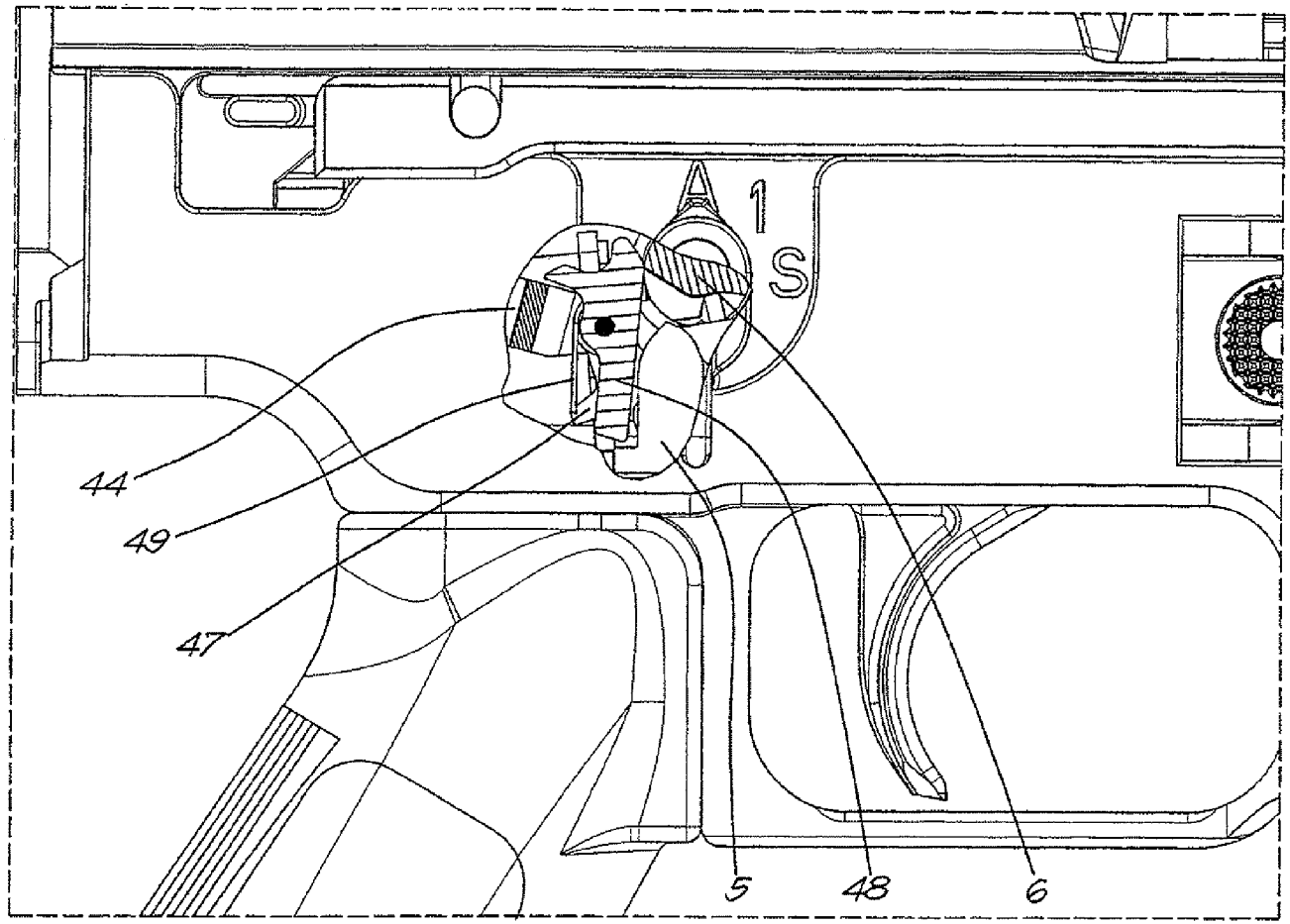

A ratchet 49 makes the semi-automatic ratchet 47 pivot in the direction of the trigger and blocks the automatic ratchet 48 with the top end that is in contact with firing selector 6, which is profiled in such a way that in the semi-automatic mode, the bottom portion of the ratchet 48 is cleared from the trigger 5 as indicated in FIG. 10, whereas in the automatic mode, this bottom portion rests on the back end of the trigger 5 as indicated in FIG. 16.

The semi-automatic ratchet 47 is equipped with a lug 50 which, when the ratchet 47 presses on the trigger 5, is placed on the rotation path of the single shot catch 32 when it is pulled downwards by the movement of the hammer 24 driven by a holding-pawl of the slide 51 which, when the slide 7 moves back, makes the hammer 24 move sufficiently further back to release the semi-automatic ratchet 47 from the trigger 5 through the single shot catch 32.

The synchronization mechanism 43 includes a blocking lever 52 of the hammer catch 28 which is mounted in a rotating manner on the axis 38, and which is also designed with a hook 53.

A release spring 54 applies pressure on the blocking lever 52 in the direction of the hammer catch 28 and holds the blocking 52 lever in contact with the firing selector 6 through a protrusion 55.

The blocking lever 52 is controlled by the firing selector which, in semi-automatic firing position, stops the blocking lever 52 in a cleared position from the hammer catch 28, and in the automatic firing position releases the blocking lever 52 so that it can hook the back end of the hammer catch 28 under the effect of the spring 54 when the trigger is pressed.

The selection control 37 for open/closed bolt mode is equipped with a radial tooth 56 that can fit in behind a tooth 57 of the blocking lever 52 in order to release the blocking lever 52 from the hammer catch 28.

Under the effect of a spring 60, a tipping and closing catch 58 blocks the hammer 24 in an armed position by the effect on the hammer 24 on a stop 59.

This closing catch 58 is held in a locked position of the hammer 24 as long as the slide has not come to the end of its closing movement of the slide 7 and is released by connecting to an end stop 61 located at the back end of the slide 7.

Functioning and use of the firearm vary according to the selection of automatic or semi-automatic mode and according to the position of the selection control on open or closed bolt mode, which is governed by the thermal actuator 13 based on the temperature of the barrel 4.

There are four types of operating mode:

Firing from the open bolt/semi-automatic firing mode;

Firing from the open bolt/automatic firing mode;

Firing from the closed bolt/semi-automatic firing mode;

Firing from the closed bolt/automatic firing mode.

The functioning of each of these operating modes is explained below.

"Firing from the Open Bolt", Semi-automatic Firing Mode

The rest position is indicated in FIGS. 8, 9 and 10.

This firing mode is characterized by the positioning of the firing selector 6 on intermittent mode and the control rod 22 placed towards the front of the firearm.

The protrusion of the piston 16 determines the position of the control rod 22 when the thermal actuator 13 reaches a temperature above the phase changing temperature.

The forward movement of the control rod 22, illustrated by the arrow B, makes the rocker 37 pivot, which in turn releases the blocking lever 52. The position of the blocking lever 52 is determined by the spring 54 and the impact of the firing selector 6 on the end 55, which prevents it from blocking the hammer catch 28.

The forward movement of the control rod 22, illustrated by the arrow B, makes the rocker 37 pivot, which also releases the slide catch 36 from its lowered position.

The semi-automatic ratchet 47 rests on the trigger 5 under the effect of the spring 49 and the automatic ratchet is released from the trigger 5 under the effect of the spring 49 and of the clearance present in the firing selector 6.

The slide 7 is held in the retracted position by the slide catch 36 and the hammer 24 is now held by the slide 7 in the armed position.

When pressure is applied on the trigger 5, as indicated on 11 by the arrow C, the front face 30 of the trigger clears the shoulder 29 of the hammer 25, with the hammer 24 resting on the slide 7.

At the same time, the back of the trigger 5 lifts the ratchet of the semi-automatic mode 47. This ratchet 47 tilts the control lever 44 around the axis 41 and this tilting movement lowers the slide catch 36 as indicated by the arrow D, which has the effect of releasing the slide 7 which then moves forward (arrow E) under the load of the recoil spring 8.

During the forward movement E of the slide 7, the bolt 9 housed in the slide 7, retrieves a cartridge from the loader and places it in the chamber in the barrel extension 4' of the barrel 4. In the course of this same E movement, the hammer 24 connects to the closing catch 58.

Figure 12:
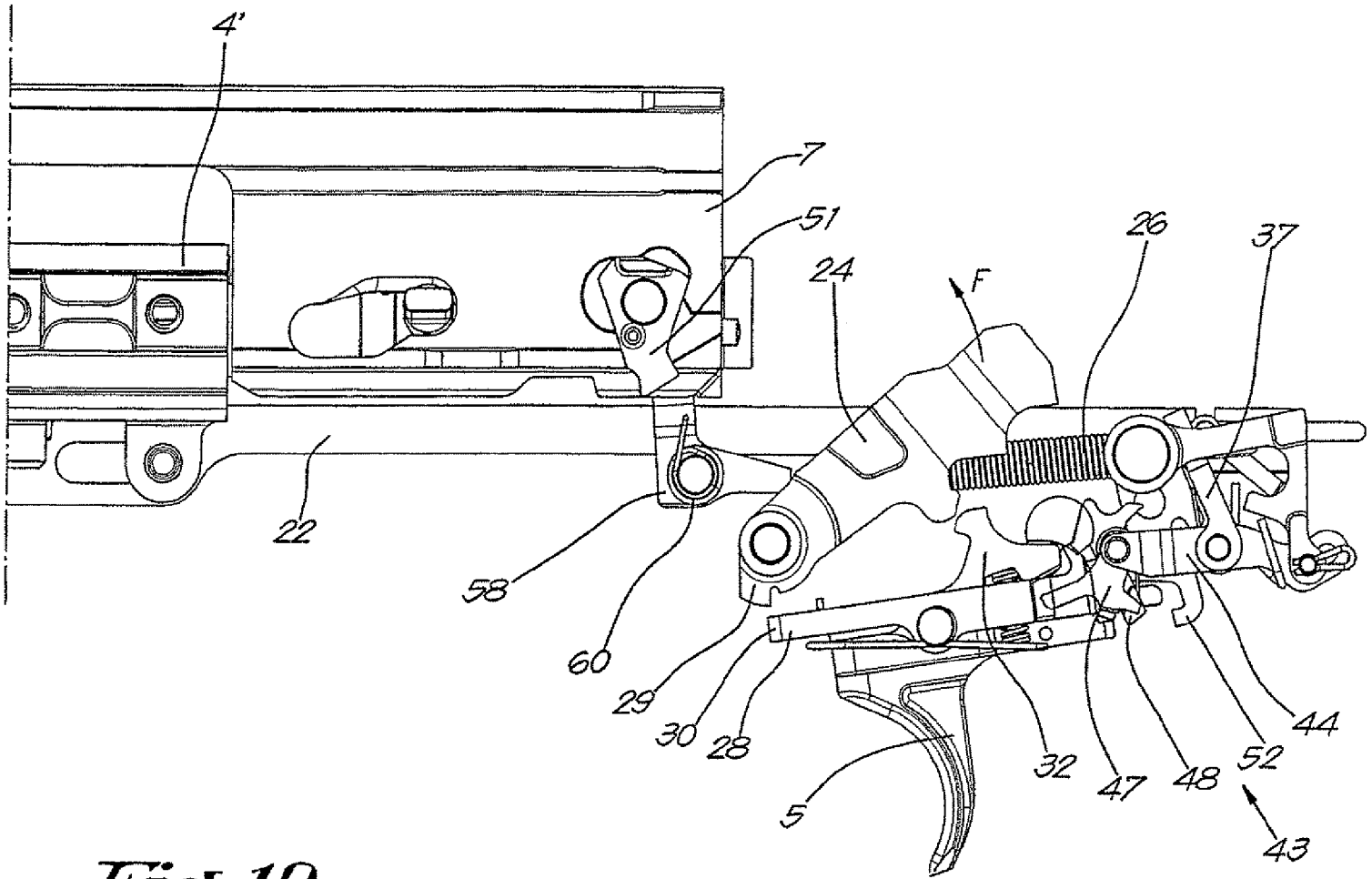

While continuing its forward movement E, the slide 7 turns the bolt 9 in barrel extension 4' of the barrel 4, then in the last phase of the movement E, makes the closing catch 57 pivot as it connects to the end stop 61 at the back of the slide 7 as indicated in FIG. 12, which releases the hammer 24 thus enabling the percussion of the cartridge located in the chamber by the tipping of the hammer 24 in the direction of the arrow F under the effect of spring 26.

Under the effect of the take-off of gas at the gas port, the slide 7 receives the impulsion that generates the backward movement of this slide 7, which in turn makes the hammer 24 pivot around the axis 25 in the opposite direction to the arrow F.

Figure 13:
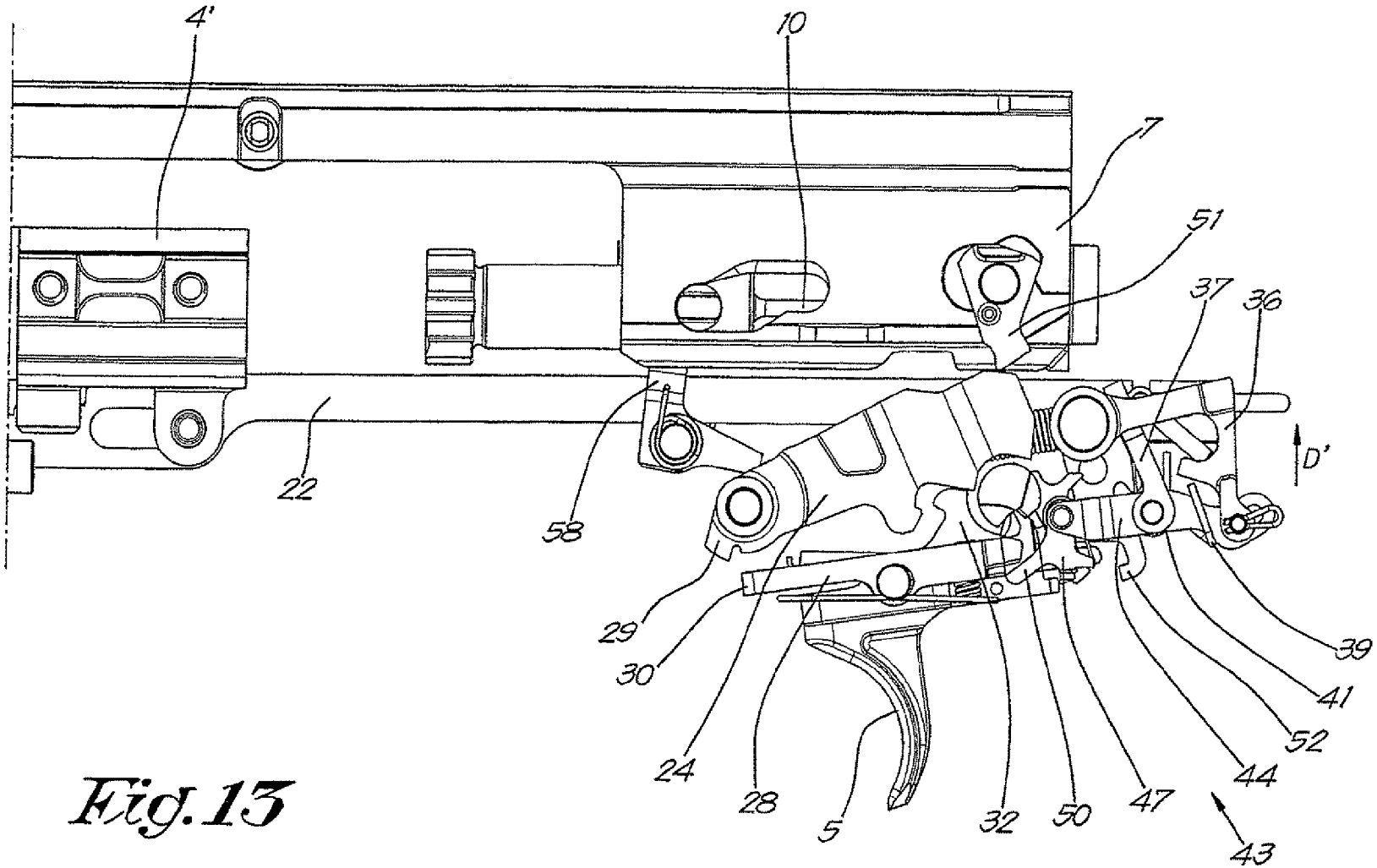

According to the illustration on FIG. 13, when the holding-pawl of the slide 51 connects with the hammer 24, this holding-pawl 51 draws down the hammer 24 to a low position, the hammer 24 strikes the single shot catch 32, which in turn makes the semi-automatic ratchet 47 pivot as it connects to the lug 50.

When it pivots, this ratchet 47 disengages from the trigger 5, which has the effect of releasing the control lever 44, which pivots around its axis under the impulsion of the catch spring 39 and allows the slide catch 39 to move in the direction indicated by the arrow D'.

When the slide 7 comes to the end of its course in the receiver 2 and returns to the level of the slide catch 36, the catch 36 will stop it.

Figure 14:
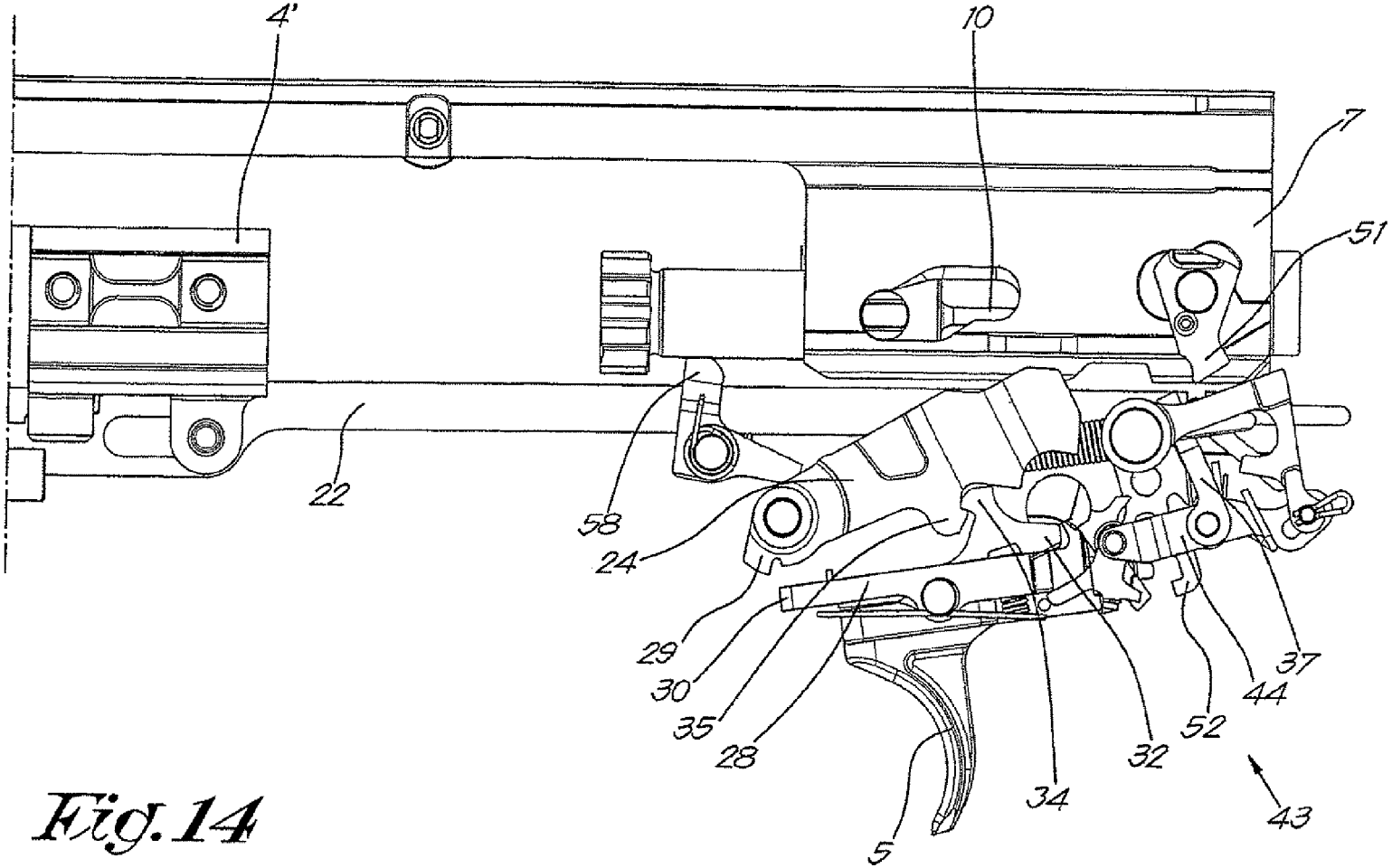

The hammer 24 is then kept in a low position by the single shot catch 32 whose hook 34 hooks behind the hook 35 of the hammer 24, as indicated in FIG. 14, until the shooter releases the pressure on the trigger 5. When the shooter releases the trigger 5, the single shot catch 32 is disengaged from the hammer 24, and the hammer 24 is held in the armed position by its contact with the slide 7.

When the shooter releases the trigger 5, the ratchet 47 will return to its position on the trigger 5 under the impulsion of the spring 49.

"Firing from the Open Bolt", Automatic Firing Mode

This firing mode is characterized by the positioning of the firing selector 6 on automatic mode and the control rod 22 placed towards the front of the firearm.

Figure 15:
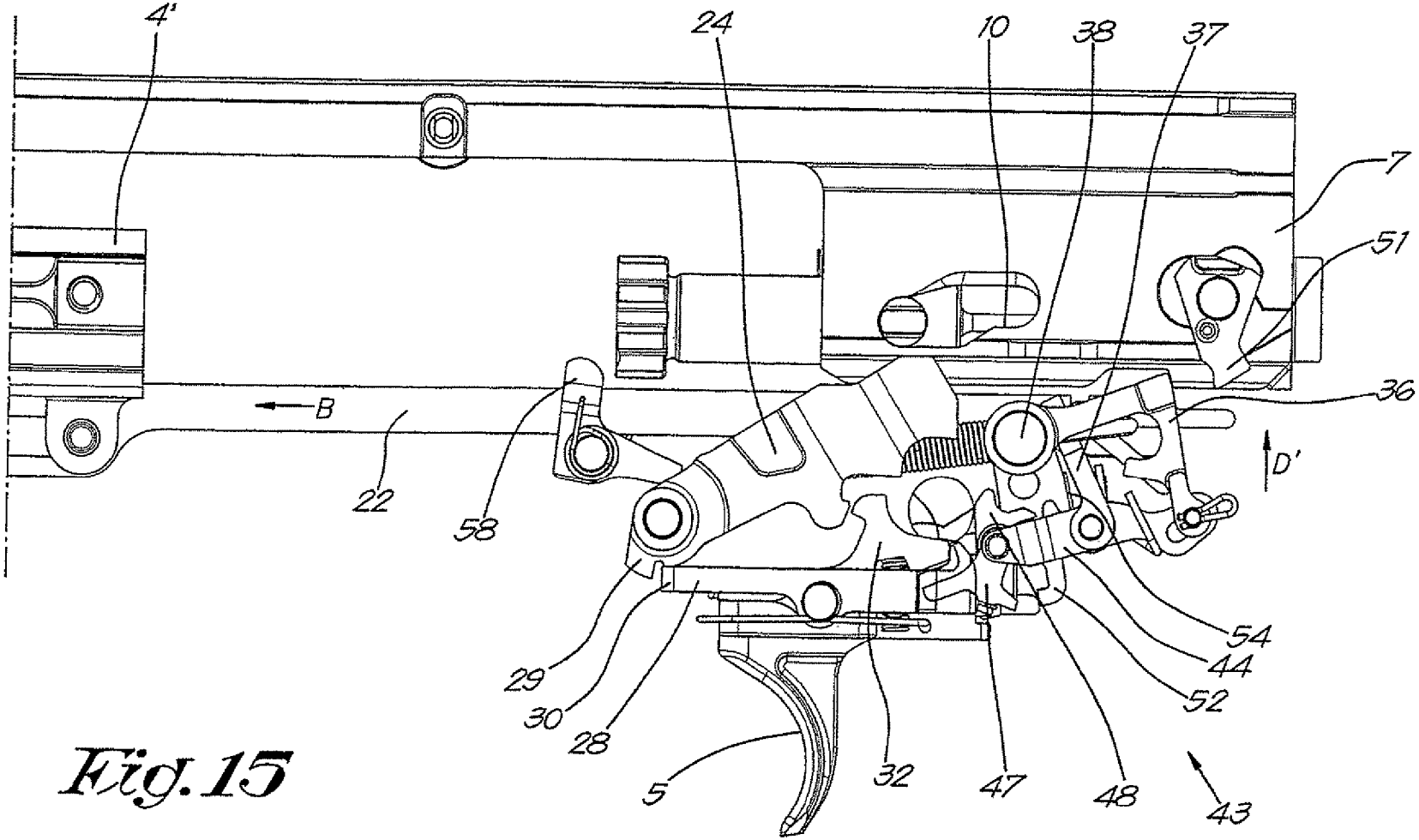
FIGS. 15 and 16 are views similar to FIGS. 8 and 10 respectively, but in rest situation with open bolt automatic firing mode.

The rest position is indicated in FIGS. 15 and 16.

The protrusion A of the piston 16 determines the position of the control rod 22 when the thermal actuator 13 reaches a temperature above the phase changing temperature.

The control rod 22 leads the blocking lever 37 in the direction indicated by B, which enables the upward movement D' of the slide catch 36 and also releases the rocker 52.

The blocking lever 52 is no longer disengaged from the hammer catch 28 by the axis of the firing selector 6, which will enable the blocking lever 52 to tilt over its axis 38 under the impulsion of the spring 54, so that when the trigger 5 is pressed, the blocking lever 52 will come and block the hammer catch 28 by the effect on the face 53.

In the rest position, as indicated in FIG. 16, the semi-automatic mode ratchet 47 rests on the trigger 5 under the effect of the spring 49 and the automatic ratchet 48 also rests on the trigger 5 through support on the axis of the firing selector 6.

The slide 7 is held in retracted position by the slide catch 36, the hammer 24 is held in the armed position by its contact with the slide 7.

Figure 17:
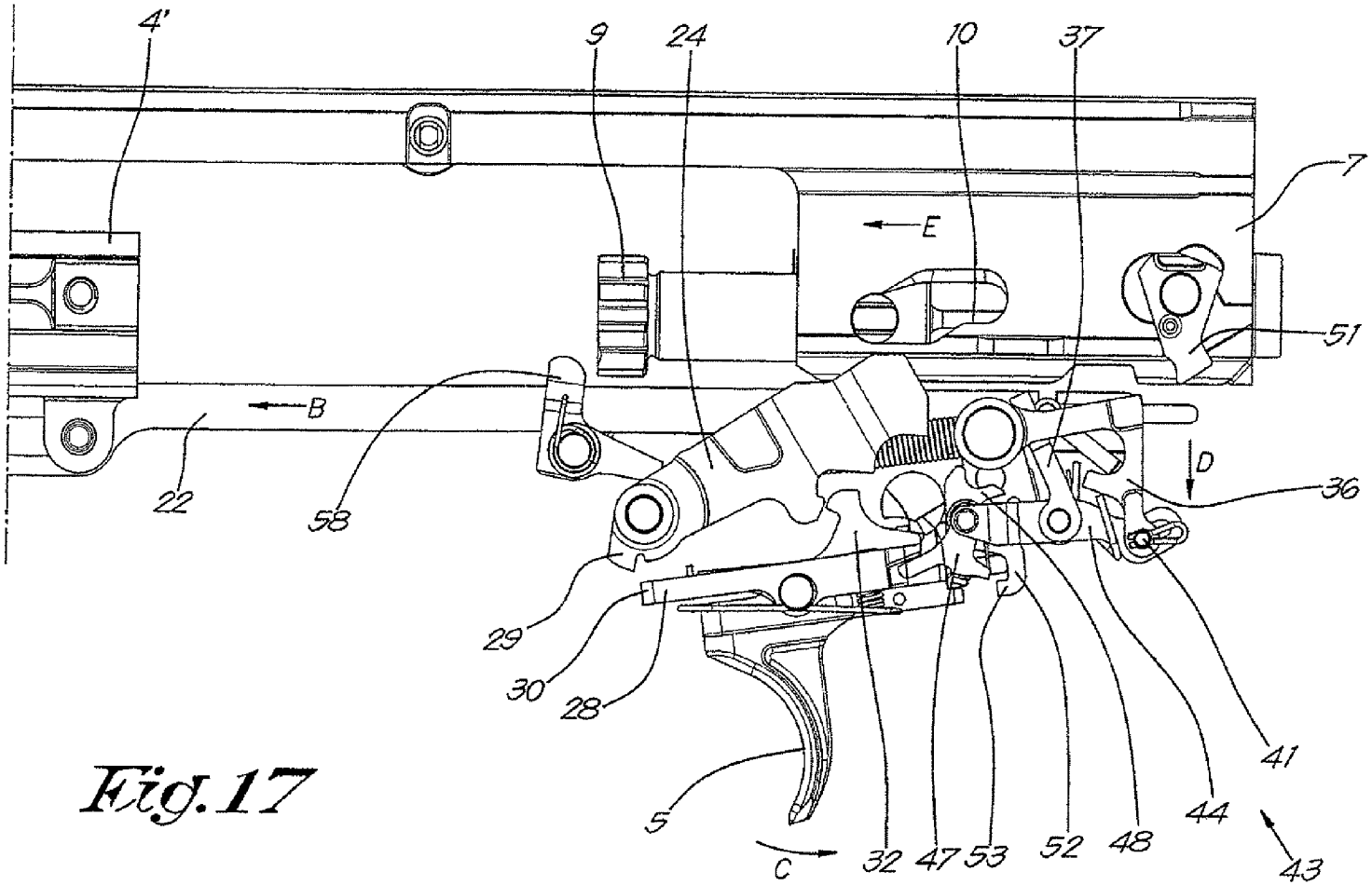
FIG. 17 corresponds to FIG. 15, with the trigger pulled.

When pressure C is applied to the trigger 5 as indicated in FIG. 17, the automatic mode ratchet 48 is lifted by the back of the trigger 5 and tilts the control lever 44 around the axis 41 and this tilting action lowers the slide catch in the direction of D, which has the effect of disengaging the slide 7 that then moves forward in the direction E under the impulsion of the recoil spring 8.

The pressure C applied on the trigger separates the face 30 of the catch from the shoulder 29 of the hammer, the hammer resting against the slide 7, then comes into contact with its shoulder 59 against the closing catch 58 once the slide 7 has moved sufficiently forward.

When the pressure C is applied to the trigger, the lever 52 moves to block the hammer catch 28 in a cleared position using its hook 53, so that the hammer 24 is able to lower itself, even if the trigger 5 is released.

When the trigger 5 is released, the firing only stops through the movement of the slide catch 36, which blocks the slide 7 in a retracted position.

In order to prevent the functioning in semi-automatic mode, the movement of the single shot catch 32 is prevented when pressure on the trigger 5 is applied, because the catch 32 butts against the firing selector 6.

The bolt 9 housed in the slide 7 removes a cartridge from the loader 3 and puts it in the chamber. The slide 7 makes the bolt 9 turn in the barrel extension 4' of the barrel 4, then in the last stage of the movement, makes the closing catch 58 pivot, which releases the hammer and enables percussion of the cartridge.

Under the effect of the take-off of gas at the level of the gas port, the slide 7 receives an impulsion that generates the backward movement of this slide 7, which in turn makes the hammer 24 pivot around the axis 25. When the holding-pawl of the slide 51 connects with the hammer 24, this holding-pawl 51 makes the hammer 24 pivot down to a low position.

Since the automatic ratchet 48 is resting on the trigger 5 through its contact with the axis of the firing selector 6, the control lever 44 is prevented from pivoting around its axis 41 and holds the slide catch 36 in a retracted position as long as pressure on the trigger 5 is applied.

When the slide 7 reaches the end of its course in the receiver 2 and returns to the level of the slide catch 36, it will not be stopped by this catch 36 and the firearm will continue to fire until the shooter releases his pressure on the trigger 5.

"Firing from the Closed Bolt", Semi-Automatic Firing Mode

Figure 19:
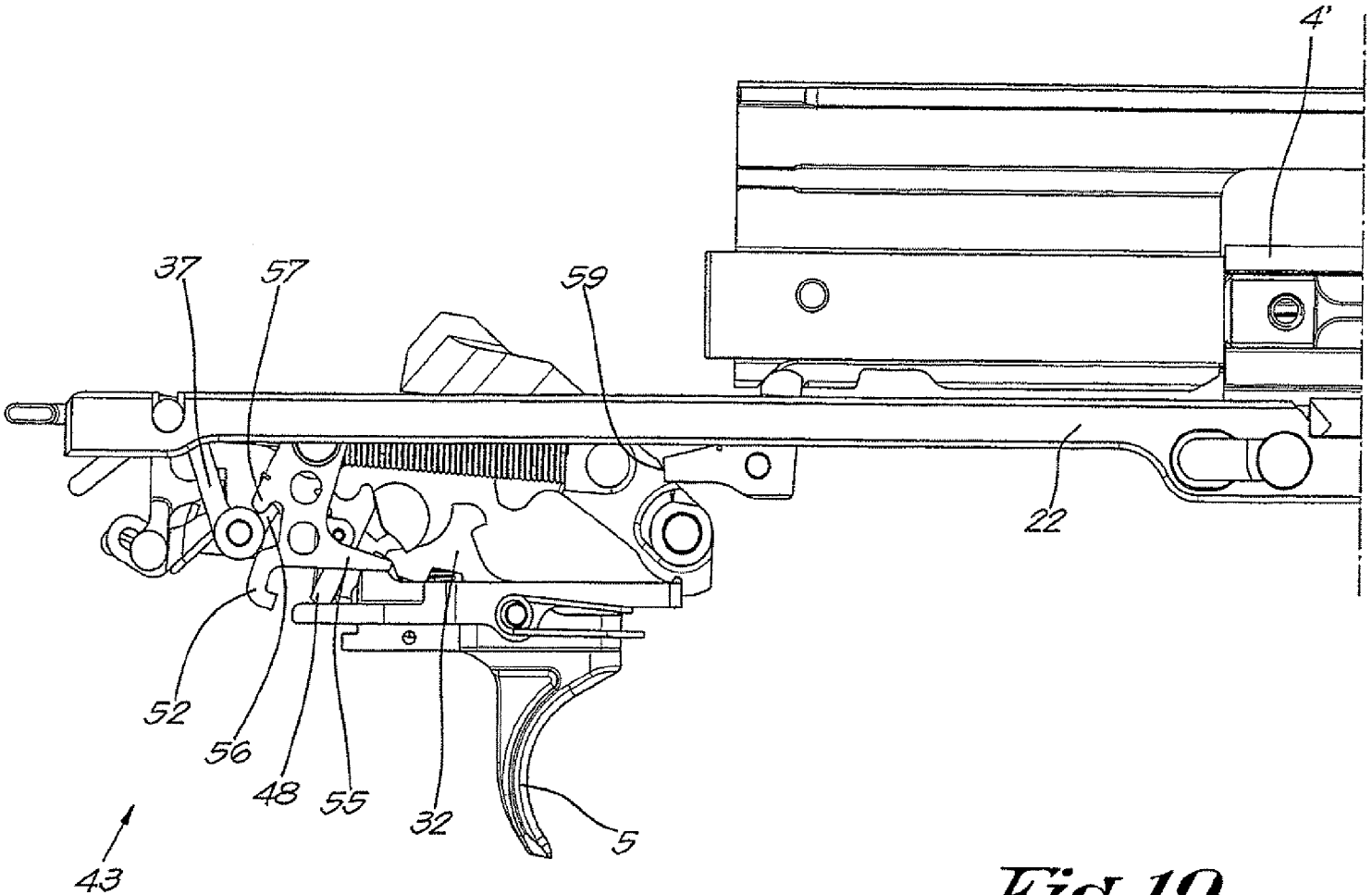

This firing mode is characterized by the positioning of the firing selector 6 on intermittent mode <<1>> and the control rod in a position B' towards the back of the firearm 1. The rest position is indicated in FIGS. 18 and 19.

The position B' of the control rod 22 is determined by the pressure of the spring 23 which makes the piston 16 retract when the thermal actuator 13 reaches a temperature that is below the phase changing temperature.

This spring 23, through the push rod 21, makes the control rod 22 move backwards.

The control rod 22 in its retracted position B' releases the blocking lever 37 which will then press on the protrusion 42 of this catch 36 and block the catch 36 through the action of the blocking lever 37 on the protrusion 42, when this catch pivots in the direction of D, thus preventing the slide catch 36, from then lifting, which at the same time releases the semi-automatic ratchet 47 and automatic ratchet 48 from the trigger 5.

The lever 52 is held disengaged from the hammer catch 28 by the lever 37 through the insertion of the tooth 56 behind the tooth 57 of the lever 52, which for this reason will not be able to block the hammer catch 28.

In a rest position, the slide 7 is placed in a forward position under the effect of the recoil spring 8, the hammer 24 is held in an armed position by the hammer catch 28 through contact of the shoulder 29 of the hammer 25 with the front face 30 of the hammer catch 28. The closing catch 58 is at the same time disengaged from the stop 59 of the hammer because of the end stop of the slide 7.

Figure 20:
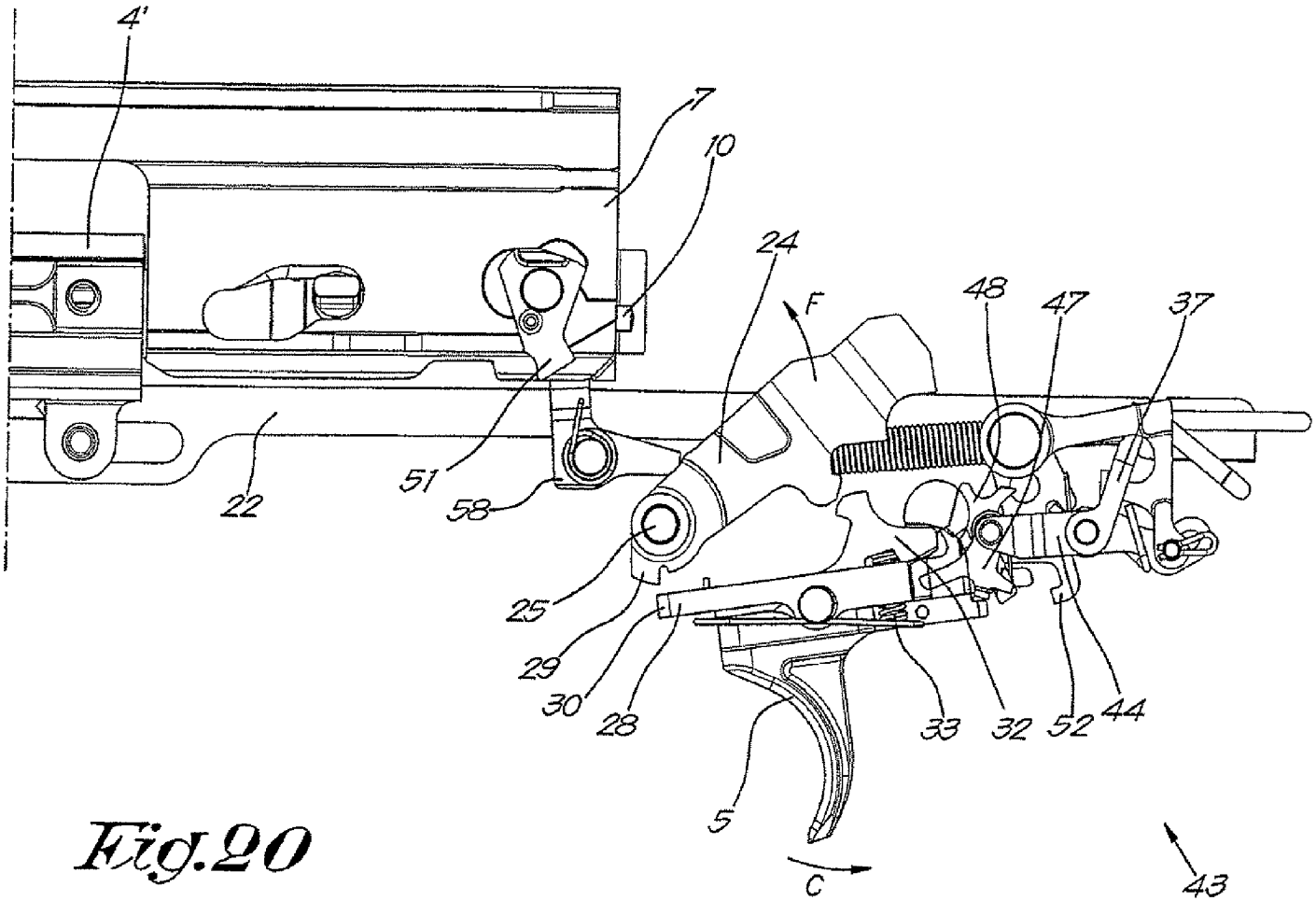
FIGS. 20 to 22 are views similar to FIG. 18, but at different moments of the firing.

When the pressure C' is applied to the trigger 5, as indicated by FIG. 20, the hammer catch 28 disengages and releases the hammer 24, which permits percussion F of the cartridge through the impact on the firing pin 10.

The single shot catch 32 places itself in a high position under the impulsion of the spring 33.

Figure 21:
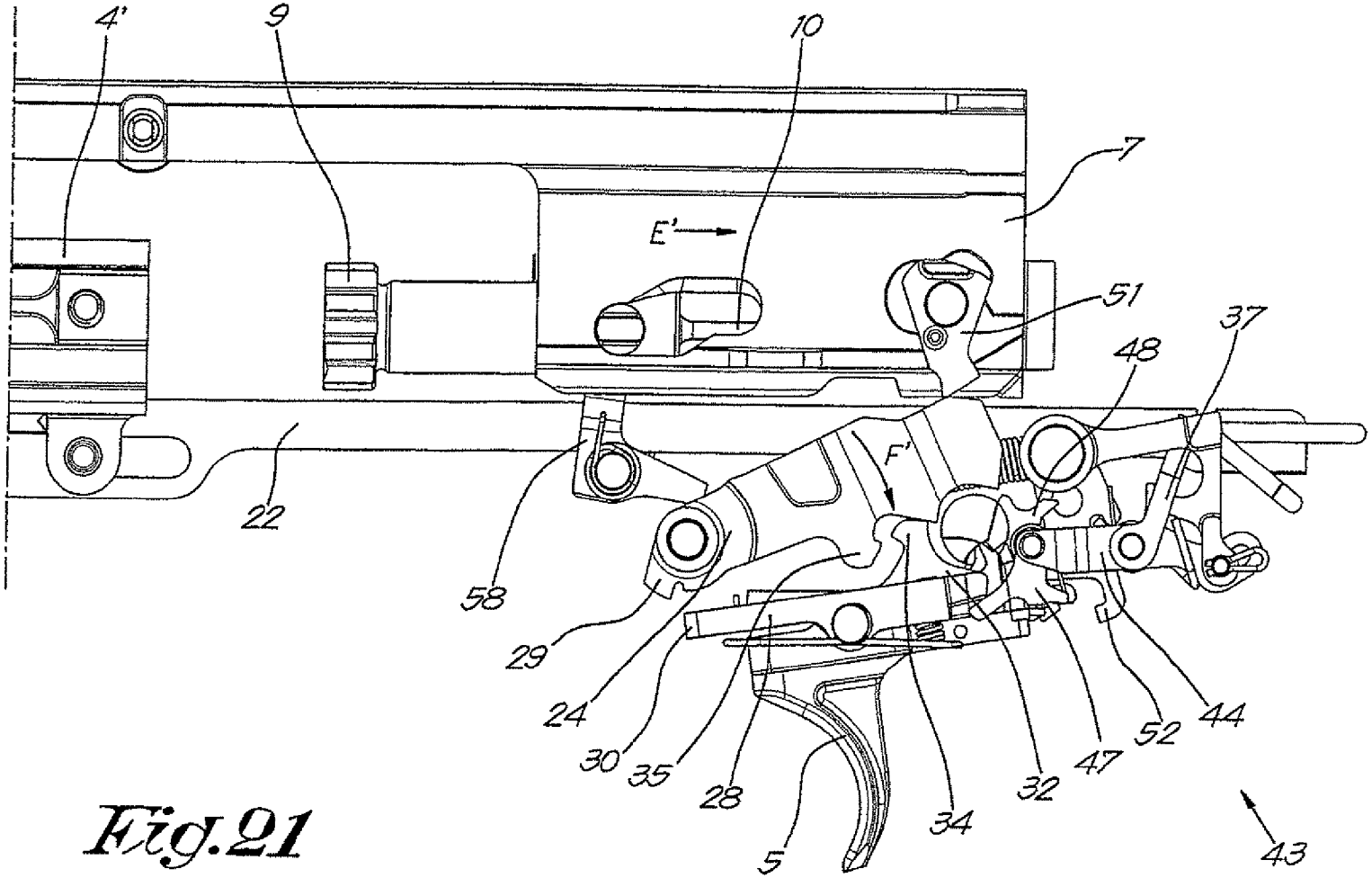

Under the effect of the take-off of gas at the level of the gas port, the slide 7 receives an impulsion that generates the backward movement E' of the slide 7, as indicated in FIG. 21, which in turn makes the hammer 24 pivot around the axis 25 to compress the hammer spring 26.

When the holding-pawl of the slide 51 connects with the hammer 24, this holding-pawl 51 makes the hammer 24 pivot down to a low position and the hook 35 of the hammer 24 goes under the hook 34 of the single shot catch 32.

Figure 22:
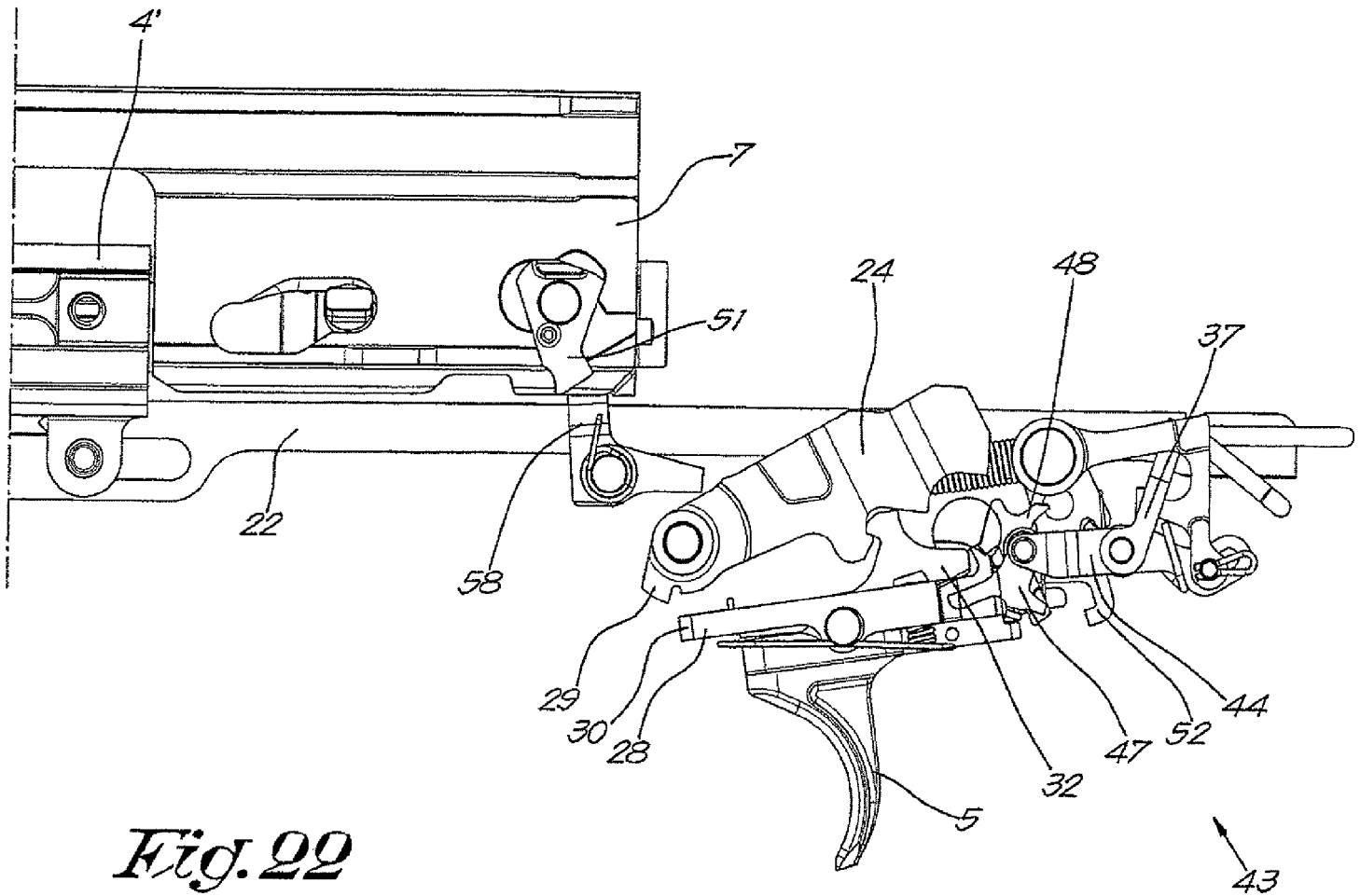

When the slide 7 reaches the end of its course in the receiver, it feeds in the next cartridge, then stops in a forward position under the effect of the recoil spring 8, as indicated in FIG. 22.

The hammer 24 is then held in place in a low position by the single shot catch 32 until the shooter releases the pressure on the trigger 5. When the shooter releases the pressure on the trigger 5, the single shot catch 32 is disengaged from the hammer 24 and the hammer 24 is held in an armed position through the contact of the face 30 of the hammer catch 28 against the shoulder 29 of the hammer 24.

"Firing from the Closed Bolt", Automatic Firing Mode

Figure 23:
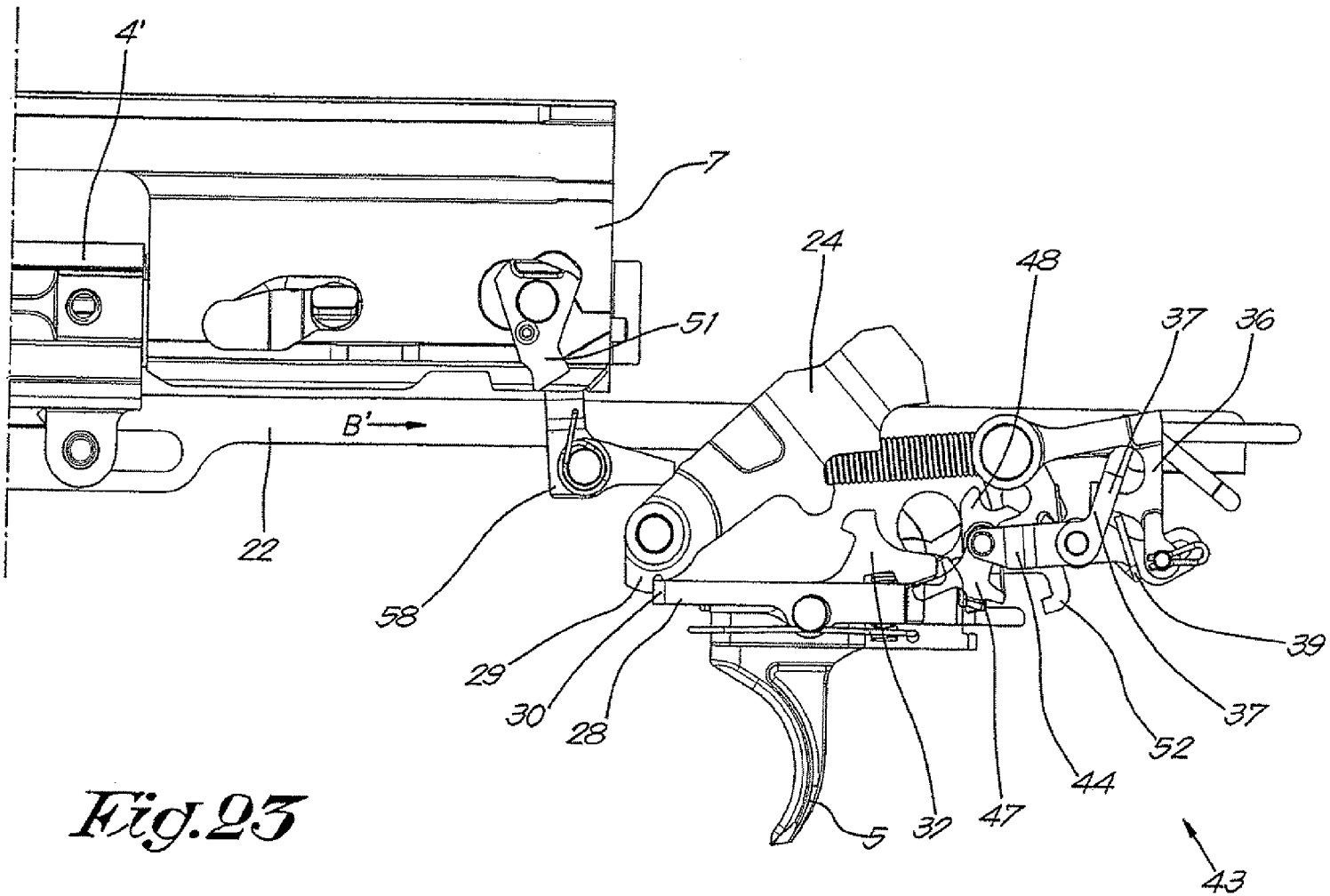
FIG. 23 is a view similar to FIG. 8 but in rest situation with closed bolt automatic firing mode.

This firing mode is characterized by the positioning of the firing selector 6 on automatic mode and the control rod 22 in a position B' towards the back of the firearm 1. The rest position is indicated in FIG. 23.

The position B' of the control rod 22 is determined by the pressure of the spring 23 which makes the piston 16 retract when the thermal actuator 13 reaches a temperature that is below the phase changing temperature.

This spring 23, through the push rod 21, makes the control rod 22 move backwards.

The control rod 22 in its retracted position B' releases the blocking lever 37 which will then press against the slide catch 36 under the effect of the spring 39, and hold the slide catch 36 in a low position.

This blocking lever 37 will prevent the slide catch 36 from rising, and though the control lever 44, will release the semi-automatic ratchet 47 and automatic ratchet 48 from the trigger 5.

The blocking lever 52 is held disengaged from the hammer catch 28 by the lever 37 through the insertion of its tooth behind the tooth 57 of the lever 52, which for this reason will not be able to block the hammer catch 28.

The slide 7 is placed in a forward rest position under the effect of the recoil spring 8, and holds the closing catch 58 in a disengaged position from the stop 59.

The hammer 24 is held in an armed position by the hammer catch 28.

Figure 24:
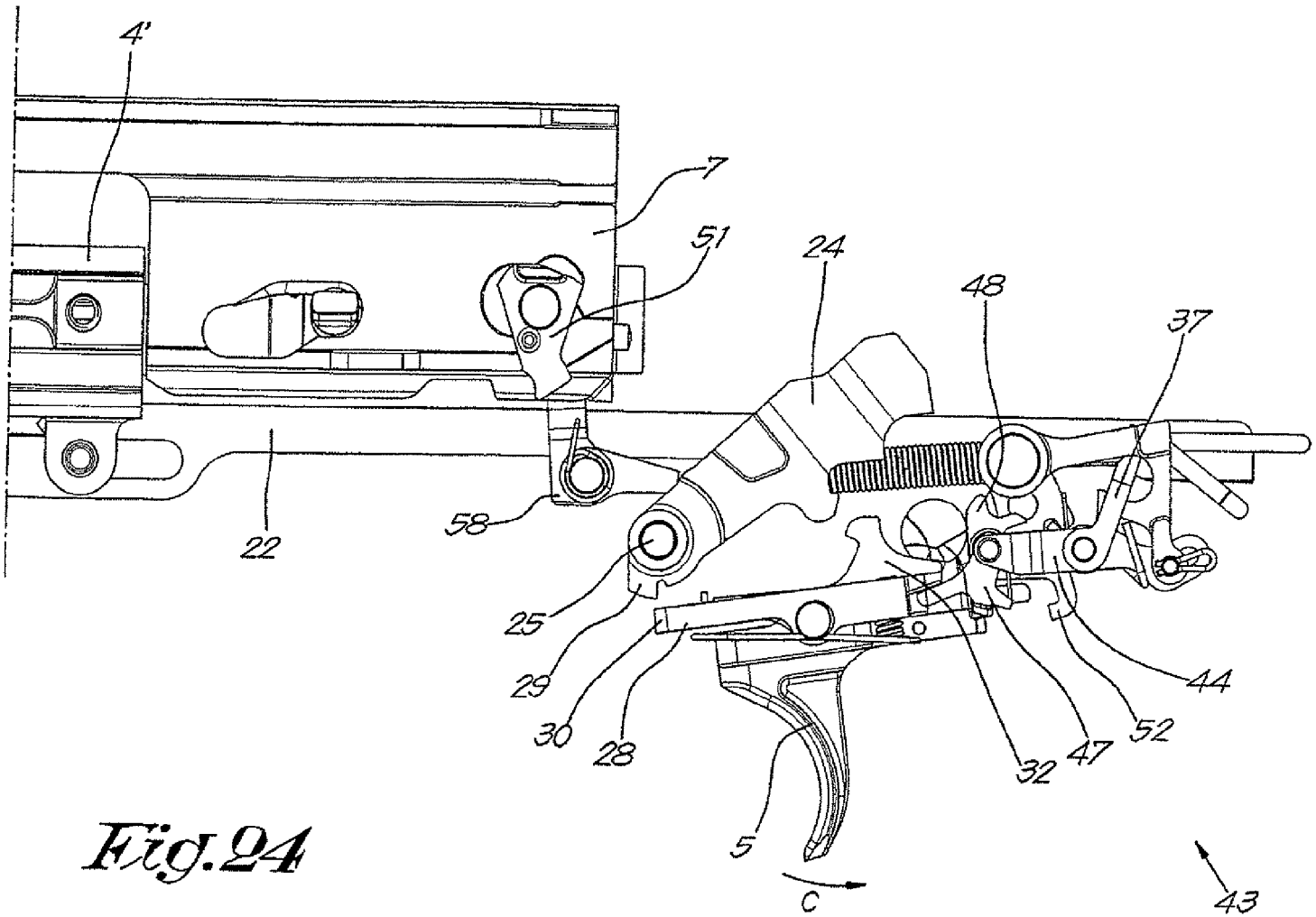
FIG. 24 is the same figure but when a shot is being fired.

When C pressure is applied on the trigger 5, as indicated in FIG. 24, the hammer catch 28 is disengaged and releases the hammer 24, which permits the percussion of the cartridge.

The single shot catch 32 is prevented from placing itself in a high position because of its connection to the firing selector 6, which prevents firing in semi-automatic mode.

Under the effect of the take-off of gas at the gas port, the slide 7 receives an impulsion that generates the backward movement of the slide 7, which in turn makes the hammer 24 pivot around the axis 25.

When the holding-pawl of the slide 51 connects to the hammer 24, this holding-pawl 51 makes the hammer 24 pivot to a low position, then the hammer 24 is held in an armed position through its contact against the slide 7.

When the slide 7 reaches the end of its course in the receiver, it feeds in the next cartridge, and then stops in a forward position under the effect of the recoil spring 8. Before reaching its forward position, the slide 7 releases the hammer 24, which will be stopped by the closing catch 58, then the slide 7 activates the closing catch 58 through the contact with the end stop 61, which has the effect of releasing the hammer 24 and to permit the next shot to fire.

The firearm then continues firing until the shooter releases the pressure on the trigger 5, which enables the hammer catch 28 to return to the rest position and put the hammer 24 in an armed position.

Generally speaking, the operating modes described above are made possible by profiles in the axis of the firing selector and the action of the selection control 37 in transferring from open bolt mode to closed bolt mode.

First, the profile of the axis of the firing selector 6 is such that:

in the semi-automatic or intermittent firing mode position:
- the automatic mode ratchet 48 is disengaged from the trigger 5;
- the blocking lever 52 of the hammer catch 28 is disengaged from the hammer catch 28;
- the single shot catch 32 is not blocked for rotation and can hold the hammer 24 in an armed position as long as pressure is applied on the trigger 5; and, In the automatic firing mode position:
- the automatic mode ratchet 48 rests on the trigger 5;
- the blocking lever 52 of the hammer catch 28 can block the hammer catch 28 when pressure is applied to the trigger 5;
- the single shot catch 32 is blocked for rotation and does not hold the hammer 24 in an armed position.

Secondly, the firing control 37 determines that:

In the closed bolt firing position:
- the slide catch 36 is blocked in a position that is disengaged from the slide;
- the blocking lever 52 is disengaged from the hammer catch 28 in order to allow free movement of the hammer catch 28;

In the open bolt firing position:
- the selection control 37 does not prevent the movement of the slide catch 36;
- the selection control 37 does not prevent the movement of the blocking lever 52, so that the hammer catch 28 can be blocked when the trigger 5 is pressed.

Generally speaking, the invention concerns a firearm which comprises a percussion mechanism which activates a firing pin 10 to use semi-automatic and automatic firing; a slide 7; a catch mechanism for firing from the open bolt whit a slide catch 36 which holds back the slide 7 in a retracted position; a mechanism to activate the firing catch with open bolt 36 and a synchronization mechanism 43 between the mechanism of this catch 36 and the percussion mechanism, the interaction between these two mechanisms being what allows the firearm to function in a reversible way with open bolt mode or closed bolt mode, depending on the position of the selection control 37.

It is clear that the invention is by no means limited to the above-described example but that numerous modifications can be made to the firearm and to the above-described processes while still remaining within the scope of the invention.

It's conceivable for example to replace the thermal actuator with another type than the above-described one or even to do without such an actuator by equipping the system with a manual control system, which lets the shooter choose to transfer from the closed bolt firing position to the open bolt firing position and vice-versa. It is also possible, for example, to have an electronic and mechanical system, which measures the temperature of the chamber and activates the transition between open bolt mode and closed bolt when this temperature reaches a given level.

The percussion mechanism to activate the firing pin 10 does not necessarily have to comprise a hammer but can also be designed with a firing pin, which is only armed by a spring and released by a catch. In this case, the synchronization mechanism will be located between the percussion mechanism and the slide catch.

The invention claimed is:

1. Automatic firearm with firing mode selector to change said automatic firearm from an automatic firing mode to a semi-automatic firing mode comprising:

a firing mechanism having a selection control arranged so as to transfer a functioning of the firearm from a closed bolt firing mode to an open bolt firing mode and from the open bolt firing mode to the closed bolt firing mode, whether in either said automatic firing mode or in said semi-automatic firing mode, wherein the selection control is activated by a thermal actuator arranged to control the transition of firing from the closed bolt mode to firing from the open bolt mode when the temperature of the barrel exceeds a pre-determined temperature and inversely controls the transition of firing from the open bolt mode to firing from the closed bolt mode when the temperature of the barrel becomes lower than a pre-determined temperature.

2. The firearm according to claim 1, wherein the thermal actuator comprises a phase change material which is mounted on the barrel and which is filled with a substance which changes phase at said predetermined temperature, such change of phase being accompanied by a change of volume, and a piston connected to the selection control through a rod.

3. Firearm comprising:

a receiver;

a loader;

a barrel with an ammunition chamber;

a slide with the ability of sliding in the direction of the barrel between a retracted position and a forward position, in order to charge and lock a cartridge in the ammunition chamber in the forward position of the slide, the slide being equipped with a firing pin and a percussion mechanism which activates the firing pin;

a trigger equipped with a catch to hold the percussion mechanism in an armed position as long as the trigger is not activated and to release the percussion mechanism when the trigger is pressed;

a single shot catch blocking the percussion mechanism in an armed position as long as the trigger is not released;

a firing selector for selecting automatic firing mode or semi-automatic firing mode to activate the single shot catch in semi-automatic firing mode and to deactivate this catch in automatic firing mode, a slide catch and a selection control which, according to the position of the selection control, blocks the slide catch in a disengaged position from the slide for closed bolt firing, or releases the slide catch-for open bolt firing so that the slide catch stops and blocks the movement of the slide in a retracted position, with a synchronization mechanism provided between the slide catch and the percussion mechanism, wherein the synchronisation mechanism comprises a semi-automatic mode ratchet which is linked by a transmission mechanism to the slide catch and which, in open bolt firing mode, rests on one end of the trigger in order to disengage the slide catch by an action on the trigger, and wherein in semi-automatic firing mode, the semi-automatic mode ratchet cooperates with the hammer in order to disengage the ratchet from the trigger during the backward movement of the slide, wherein the slide catch is released so that it stops and blocks the movement of the slide in a retracted position by a catch spring.

4. Firearm according to claim 3, wherein the percussion mechanism comprises a hammer which pivots around an axis to activate the firing pin under the impulsion of a spring which is armed by the backward movement of the slide and wherein the trigger comprises a hammer catch to hold the hammer in an armed position as long as the trigger is not activated and to release the hammer when the trigger is pressed and wherein the synchronisation mechanism is located between the slide catch and the hammer.

5. Firearm according to claim 3, wherein the transmission mechanism of the synchronization mechanism comprises a control lever that is pivotable around an axis secured in the receiver and equipped with said catch spring, one end of the control lever being articulated to one end of the slide catch which is mounted on a pivot of the receiver, the other end of the lever being equipped with a rotation axis which supports the ratchet which, in open bolt firing mode, rests on the trigger under the effect of the catch spring and of a release spring of the ratchet.

6. Firearm according to claim 3, wherein the semi-automatic ratchet cooperates with the hammer through the single shot catch.

7. Firearm according to claim 3, wherein the semi-automatic ratchet is equipped with a lug which, when the ratchet rests on the trigger, is located in the rotation path of the single shot catch and that the slide is equipped with a holding-pawl of the slide which, when the slide moves backwards, makes the hammer pivot sufficiently far in the direction of the single shot catch to activate the catch in order to disengage the semi-automatic ratchet from the trigger.

8. Firearm according to claim 3, wherein the synchronization mechanism comprises an automatic mode ratchet which is linked by a transmission mechanism to the slide catch and which, in semi-automatic firing mode, is held disengaged from the trigger by a release spring and which, in automatic firing mode, is made to rest on one end of the trigger through action of the firing selector in automatic firing mode in order to disengage the slide catch by action on the trigger.

9. Firearm according to claim 8, wherein the transmission mechanism is the same for the semi-automatic mode ratchet and the automatic mode ratchet and the two ratchets are supported by a rotation axis fastened to one end of the control lever of the transmission mechanism.

10. Automatic firearm with firing mode selector to change said automatic firearm from an automatic firing mode to a semi-automatic firing mode comprising:

a firing mechanism having a selection control arranged so as to transfer a functioning of the firearm from a closed bolt firing mode to an open bolt firing mode and from the open bolt firing mode to the closed bolt firing mode, whether in either said automatic firing mode or in said semi-automatic firing mode, including a percussion mechanism arranged to activate a firing pin enabling semi-automatic and automatic firing; a slide; a slide catch enabling the slide to be held in a retracted position; an activation mechanism for the slide catch and a synchronization mechanism between the slide catch or the activation mechanism for the slide catch and the percussion mechanism to obtain a synchronization enabling the firearm to function in an interchangeable manner in closed bolt mode or open bolt mode according to the position of the selection control, wherein the selection control is configured in the shape of a blocking lever which, in a position corresponding to open bolt firing mode, blocks the slide catch in a position disengaging it from the slide and which, in the position corresponding to closed bolt firing mode, does not prevent the movement of the slide catch.

11. Firearm according to claim 10, wherein the blocking lever is mounted in such a way that it can pivot on the axis of the control lever.

12. The firearm according to claim 4, wherein the synchronization mechanism comprises a blocking lever of the hammer catch, equipped with a release spring which exerts a force on the blocking lever in the direction of the hammer catch which is controlled by the firing selector which, in semi-automatic firing mode, disengages the blocking lever from the hammer catch in order to allow free movement of said catch, and, in the automatic firing mode, releases the blocking lever in order to block the hammer catch when the trigger is pressed.

13. Firearm according to claim 12, wherein the blocking lever of the hammer catch is pivotable around the axis of the slide catch and is equipped with a hook which engages behind the hammer catch.

14. Firearm according to claim 12, wherein the selection control for open bolt firing mode or closed bolt firing mode is arranged so that in closed bolt position, the blocking lever of the hammer catch is blocked in a disengaged position from the hammer catch in order to allow free movement of the hammer catch.

15. Firearm according to claim 14, wherein the selection control is equipped with a tooth which lodges behind another tooth of the blocking lever.

16. Firearm according to claim 12, wherein the firing selector is shaped in such a way that:

in the semi-automatic firing mode:

the automatic ratchet is disengaged from the trigger;

the blocking lever of the hammer catch is disengaged from the hammer catch;

the single shot catch is not prevented from rotating and holds the hammer in an armed position as long as the trigger is pressed; and in the automatic firing mode:

the automatic ratchet rests on the trigger;

the blocking lever of the hammer catch blocks the hammer catch when the trigger is pressed;

the single shot catch is prevented from rotating and can not hold the hammer in an armed position.

17. Firearm according to claim 12, wherein the selection control is configured so that:

in the closed bolt firing mode:

the slide catch is blocked in a position that is disengaged from the slide;

the blocking lever is disengaged from the hammer catch in order to allow free movement of the hammer catch;

in the open bolt firing mode:

the selection control does not prevent the movement of the slide catch;

the selection control does not prevent the movement of the blocking lever so that the hammer catch is blocked when the trigger is pressed.

* * * * *